US009856839B2

(12) United States Patent
Kanbara et al.

(10) Patent No.: US 9,856,839 B2
(45) Date of Patent: Jan. 2, 2018

(54) FUEL INJECTION VALVE AND FUEL INJECTION VALVE CONTROLLER

(71) Applicant: DENSO CORPORATION, Kariya, Aichi-pref. (JP)

(72) Inventors: Motoya Kanbara, Nishio (JP); Fumiaki Arikawa, Nishio (JP); Satoshi Sugawara, Kariya (JP); Daiji Ueda, Kariya (JP); Hiroki Tanada, Kariya (JP); Toshiaki Hijima, Nishio (JP); Hitoshi Maegawa, Nishio (JP); Naoki Toda, Nishio (JP)

(73) Assignee: DENSO CORPORATION, Kariya (JP)

( * ) Notice: Subject to any disclaimer, the term of this patent is extended or adjusted under 35 U.S.C. 154(b) by 86 days.

(21) Appl. No.: 15/170,023

(22) Filed: Jun. 1, 2016

(65) Prior Publication Data

US 2016/0356251 A1 Dec. 8, 2016

(30) Foreign Application Priority Data

Jun. 5, 2015 (JP) ..... 2015-114556
Mar. 7, 2016 (JP) ..... 2016-43629

(51) Int. Cl.
*F02M 51/06* (2006.01)
*F02M 45/10* (2006.01)
(Continued)

(52) U.S. Cl.
CPC ..... *F02M 45/10* (2013.01); *F02M 47/027* (2013.01); *F02M 51/0603* (2013.01);
(Continued)

(58) Field of Classification Search
CPC ..... F02M 47/027; F02M 51/0603; F02M 51/0607; F02M 51/0639; F02M 51/0642;
(Continued)

(56) References Cited

U.S. PATENT DOCUMENTS

2003/0127615 A1* 7/2003 Fischer ..... F02M 51/0603 251/57
2004/0041037 A1* 3/2004 Klugl ..... F02M 57/025 239/533.2

(Continued)

FOREIGN PATENT DOCUMENTS

JP 11-200981 7/1999
JP 2010-285910 12/2010

*Primary Examiner* — Erick Solis
(74) *Attorney, Agent, or Firm* — Nixon & Vanderhye P.C.

(57) ABSTRACT

A fuel injection valve includes a body including a first chamber that supplies fuel of a first pressure, a second chamber that supplies fuel of a second pressure, and an injection hole, a valve chamber member including a valve chamber connectable to the first chamber and the second chamber, a control chamber member including a control chamber connectable to the first chamber, a needle pressed by pressure of fuel in the control chamber in a direction that causes fuel injection from the injection hole to stop, an actuator, a valve element that selectively connects the first chamber, second chamber, and the valve chamber according to the actuator extending and contracting, and a transmission mechanism that when the actuator extends, transmits the force to the needle as a force in a direction that causes fuel to be injected from the injection hole.

33 Claims, 26 Drawing Sheets

(51) Int. Cl.
*F02M 47/02* (2006.01)
*F02M 63/00* (2006.01)

(52) U.S. Cl.
CPC .... *F02M 51/0607* (2013.01); *F02M 63/0026* (2013.01); *F02M 2200/21* (2013.01); *F02M 2200/704* (2013.01)

(58) Field of Classification Search
CPC ..... F02M 51/0653; F02M 51/0657; F02M 51/0682; F02M 63/0026; F02M 2200/21; F02M 2200/704
USPC ..... 123/472; 239/585.5
See application file for complete search history.

(56) References Cited

U.S. PATENT DOCUMENTS

| | | | | |
|---|---|---|---|---|
| 2004/0108477 | A1* | 6/2004 | Stoecklein | F02M 47/027 251/57 |
| 2006/0208107 | A1* | 9/2006 | Heinz | F02M 45/083 239/533.2 |
| 2012/0160210 | A1* | 6/2012 | Jaime Salcedo | F02M 51/0603 123/294 |
| 2012/0160214 | A1* | 6/2012 | Salcedo | F02M 51/0603 123/446 |
| 2015/0369177 | A1* | 12/2015 | Coldren | F02M 21/0275 123/294 |

* cited by examiner

FUEL INJECTION VALVE AND FUEL INJECTION VALVE CONTROLLER

CROSS REFERENCE TO RELATED APPLICATION

The present application is based on Japanese Patent Application No. 2015-114556 filed on Jun. 5, 2015 and Japanese Patent Application No. 2016-043629 filed on Mar. 7, 2016, disclosure of which is incorporated herein by reference.

TECHNICAL FIELD

The present disclosure relates to a fuel injection valve for an internal combustion engine, and a controller that controls a fuel injection valve.

BACKGROUND

Regarding direct acting fuel injection valves for internal combustion engines, it is known that when a piezo stack extends, a needle is pressed and lifted through fuel stored in an oil-tight chamber, and an injection hole of a fuel injection valve is opened. Such a technique is disclosed in, for example, JP 2010-285910.

SUMMARY

However, according to the technique of JP 2010-285910, since a large amount of driving energy may be needed to lift the needle, the fuel injection pressure may be limited.

In view of the above, it is an object of the present disclosure to provide a fuel injection valve with the advantages of direct acting fuel injection valves, while reducing the driving energy needed to lift a needle to allow for a higher fuel injection pressure.

According to the present disclosure, a fuel injection valve comprises a body including a first chamber that supplies fuel at a first pressure, a second chamber that supplies fuel at a second pressure, the second pressure being lower than the first pressure, and an injection hole, a valve chamber member including a valve chamber, the valve chamber being connectable to the first chamber and the second chamber, a control chamber member including a control chamber, the control chamber being connectable to the first chamber, a needle, the needle being pressed by pressure of fuel in the control chamber in a direction that causes fuel injection from the injection hole to stop, an actuator driven to extend and contract, a valve element that blocks the second chamber from the valve chamber and connects the first chamber with the control chamber with each other when the actuator is in a contracted state, and changes position when the actuator extends to connect the second chamber, the valve chamber, and the control chamber with each other and block the first chamber from the control chamber, and a transmission mechanism that transmits a force generated by the actuator extending, which causes the valve element to displace, to the needle as a force in a direction that causes fuel to be injected from the injection hole.

According to the above configuration, the fuel injection valve includes the body provided with the first chamber, the second chamber, and the injection hole. Fuel at the first pressure is supplied at the first chamber. Fuel at the same pressure, which is lower than the first pressure, is supplied at the second chamber. Further, the valve chamber member is provided, and the valve chamber, which is connectable to the first chamber and the second chamber, is provided in the valve chamber member. In addition the control chamber member is provided, and the control chamber which is connectable to the first chamber is disposed. Due to the pressure of the fuel in the control chamber, the needle is pressed in the direction that causes fuel injection from the injection hole to stop.

In addition, the actuator and the valve element are provided in the fuel injection valve. When the actuator is in the contracted state, the valve element blocks the second chamber from the valve chamber, and connects the first chamber with the control chamber. Accordingly, when the actuator is in the contracted state, the fuel at the first pressure stored in the first chamber flows into the control chamber. When the actuator extends, the valve element connects the second chamber with the valve chamber, and blocks the first chamber from the control chamber. Accordingly, when the actuator is extended, the fuel stored in the control chamber flows through the valve chamber and out into the second chamber, and the control chamber depressurizes. For this reason, the force pressing the needle in the direction that causes fuel injection from the injection hole to stop is decreased. In this state, the force generated by the actuator, which causes the valve element to displace, is transmitted by the transmission mechanism to the needle as a force in the direction that causes fuel to be injected from the injection hole. Since the depressurization of the control chamber reduces the force pressing the needle in the direction that causes fuel injection from the injection hole to stop, the amount of force in the direction that causes fuel to be injected from the injection hole transmitted from the transmission mechanism to the needle may be smaller than conventional. As a result, the advantages of direct acting fuel injection valves are gained, while the amount of charge energy needed to cause the needle to lift is reduced, and the fuel injection pressure may be easily increased.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

A fuel injection valve 100 is mounted by being inserted into a cylinder head of an engine, and directly injects fuel supplied from a common rail to the combustion chamber of each cylinder of the engine.

Figure 1:
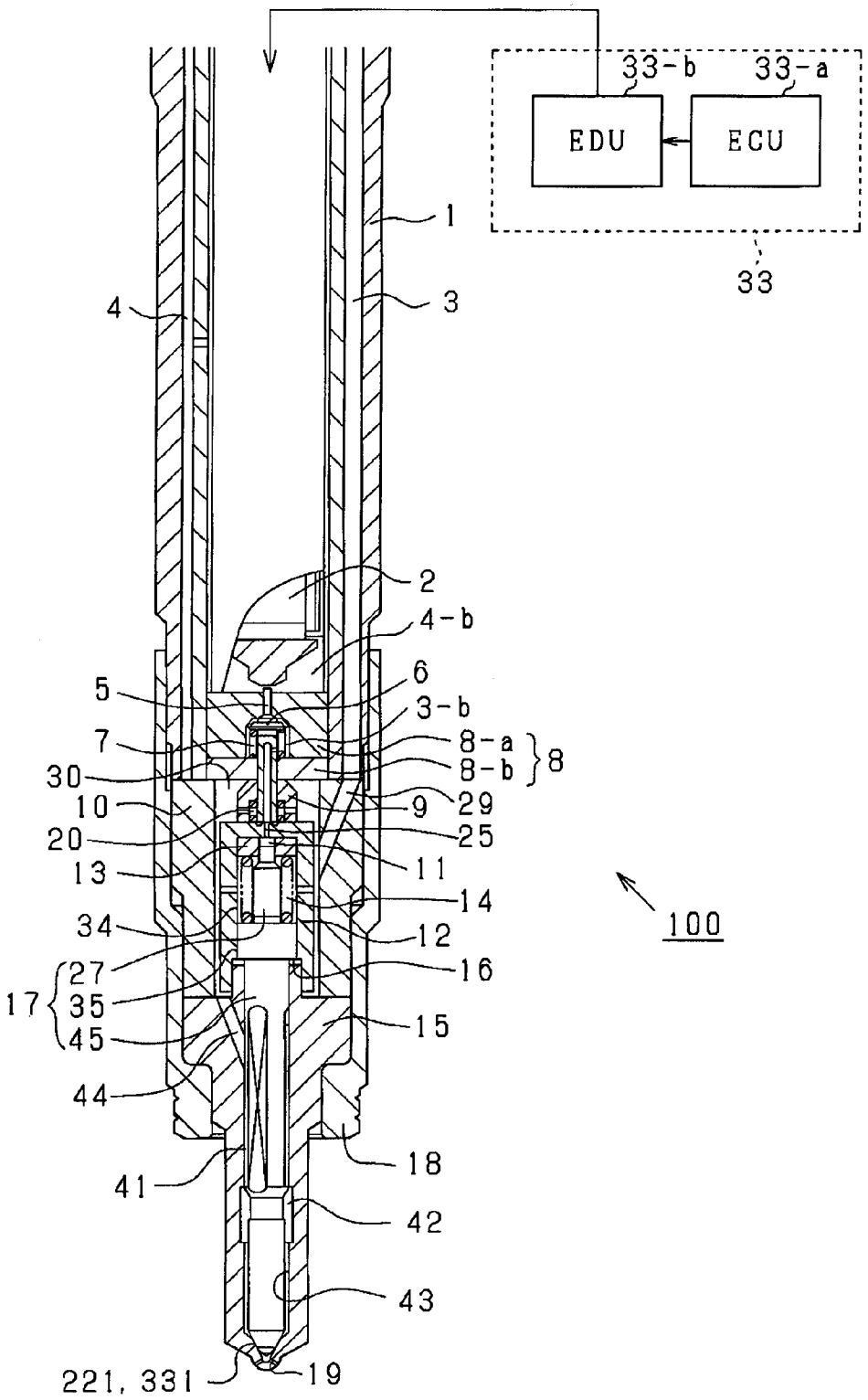
FIG. 1 is a cross sectional view of a fuel injection valve according to a present embodiment.
Figure 2:
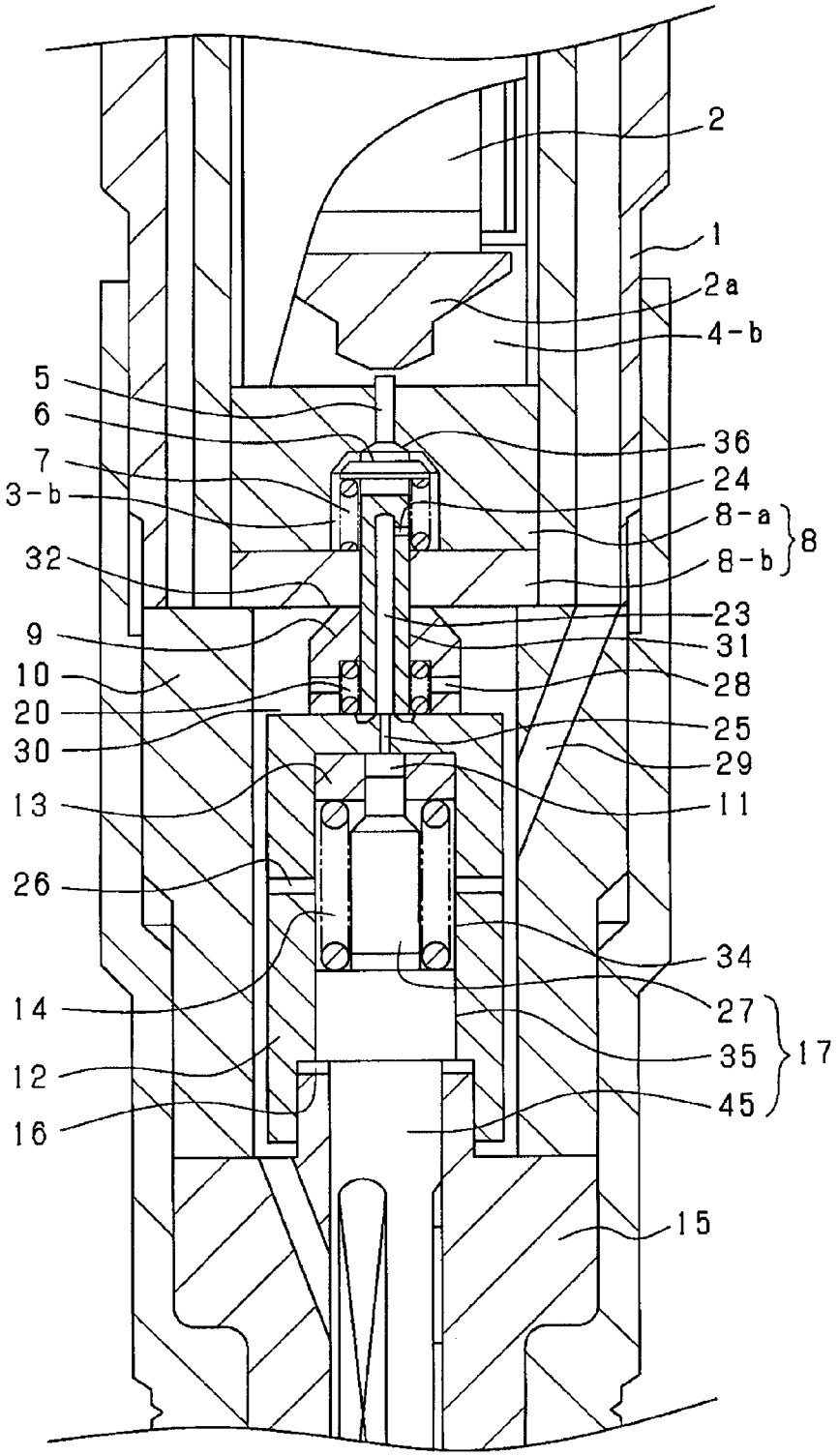
FIG. 2 is an enlarged cross sectional view around a control chamber of FIG. 1.

As shown in FIGS. 1 and 2, this fuel injection valve 100 includes an injector body 1, a lower body 10, a nozzle body 15, a needle 17, an actuator 2, and a driver 33.

The nozzle body 15 is formed as a substantially cylindrical body, and is fixed by a retaining nut 18 to the lower side of the figure of the injector body 1 (i.e., the injection side) through the lower body 10. A guide bore (needle housing chamber) 43 and an injection hole 19 are formed in the nozzle body 15. The guide bore 43 slidably houses a cylindrical needle 17. The injection hole 19 injects fuel when the needle 17 is lifted up. In addition, the injector body 1, the lower body 10, and the nozzle body 15 correspond to a main body. In the specification, the nozzle body 15 side of the injector body 1 (the lower side in FIG. 1) is referred to as a "lower side", and the opposite side (the upper side in FIG. 1) is referred to as an "upper side".

The guide bore 43 is bored from an upper end surface of the nozzle body 15 to a tip portion of the nozzle body 15. In addition, the guide bore 43 forms a first high pressure passage 41 from a gap between the inner circumference surface of the guide bore 43 and the outer circumferential surface of the needle 17. The first high pressure passage 41 guides high pressure fuel to the injection hole 19. Further, the inner diameter of the nozzle body 15 is enlarged to form a fuel reservoir 42 partway through the guide bore 43.

A conical seating surface 221 is formed on a tip portion of the first high pressure passage 41 in the inner circumferential surface of the nozzle body 15, i.e., a tip portion toward the injection hole 19. A seat surface 331 that seats on the seating surface 221 is formed on a tip portion of the needle 17. By seating the seat surface 331 on the seating surface 221, the needle 17 closes and blocks the first high pressure passage 41 from communicating with the injection hole 19.

Further, a first flow path 44 is formed in the nozzle body 15. The first flow path 44 connects the first high pressure passage 41 to a high pressure chamber (corresponding to a first chamber) 30 formed in the lower body 10. A high pressure fuel (corresponding to fuel at a first pressure) guided from a high pressure port 3, described later, is stored in the high pressure chamber 30. Accordingly, the high pressure fuel flows into the first high pressure passage 41 through the first flow path 44. As a result, when the seat surface 331 of the needle 17 separates from the seating surface 221, the high pressure fuel flowing into the first high pressure passage 41 is injected.

The lower body 10 is formed as a substantially cylindrical body. A portion of the upper end portion (the end portion facing away from the injection hole) of the nozzle body 15 penetrates into the lower body 10. The high pressure chamber 30 formed in the lower body 10 houses a valve cylinder 9 and a large-diameter piston 12. A second flow path 29 is connected to the high pressure chamber 30, and high pressure fuel flowing in from the high pressure port 3 through the second flow path 29 is stored in the high pressure chamber 30.

A pressing chamber 34 is formed inside the large-diameter piston 12 (corresponding to a particular component included in a transmission mechanism). The pressing chamber 34 houses a portion of the needle 17. In addition, a first communication passage 26 is disposed in the large-diameter piston 12 such that high pressure fuel flows in from the high pressure chamber 30. The first communication passage 26 is connected to the pressing chamber 34.

The needle 17 includes a small-diameter piston portion 27, a pressing portion 35, and a circular column portion 45. A nozzle spring 14 is housed in the pressing chamber 34 disposed in the large-diameter piston 12. The small-diameter piston portion 27 is inserted inside the nozzle spring 14. The lower end portion of the small-diameter piston portion 27 is coupled to the upper end portion of the pressing portion 35, and the lower end portion of the pressing portion 35 is coupled to the circular column portion 45.

A needle cylinder (corresponding to a control chamber member) 13 is disposed at an upper end side in the pressing chamber 34 (i.e., the upper side of the nozzle spring 14). The needle cylinder 13 is formed in a substantially cylindrical shape, and a control chamber 11 is formed within the needle cylinder 13. The upper end portion of the small-diameter piston portion 27 is inserted into the control chamber 11. The small-diameter piston portion 27 is slidably supported by the needle cylinder 13. Due to the nozzle spring 14 housed in the pressing chamber 34, the needle cylinder 13 is biased in an opposite direction from the injection hole 19 (i.e., an upward direction), and the pressing portion 35 is biased toward the injection hole 19.

An oil-tight chamber 16 is defined by a portion of the needle 17 around the lower end of the pressing portion 35, a lower portion of the large-diameter piston 12, and a portion of the nozzle body 15 which protrudes into the lower body 10.

A substantially cylindrical valve cylinder 9 is housed in the high pressure chamber 30 such that the lower end portion of the valve cylinder 9 is abuttable with the upper end portion of the large-diameter piston 12. A second communication passage 28 is disposed in the valve cylinder 9 such that the high pressure fuel stored in the high pressure chamber 30 flows into the valve cylinder 9. A cylinder spring (corresponding to a cylinder biasing member) 20 is disposed within the valve cylinder 9. Due to the cylinder spring 20, the valve cylinder 9 is biased in a direction opposite from the injection hole 19 (the up direction in FIG. 1).

A common orifice 25 is disposed in the large-diameter piston 12 so as to be connectable with the insides of the control chamber 11 and the valve cylinder 9. For this reason, the high pressure fuel stored in the high pressure chamber 30 is able to flow through the second communication passage 28 and the common orifice 25 into the control chamber 11.

The injector body 1 is formed in a substantially cylindrical shape, and a valve body (corresponding to a valve chamber member) 8 is housed at a lower portion inside the injector body 1. A lower end portion of a valve body 8-*b* of the valve body 8 abuts the upper end portion of the valve cylinder 9 at a valve cylinder seat position 32. In addition, The upper end portion of the valve body 8-*b* abuts a lower end portion of a valve body 8-*a*. A substantially cylindrical valve chamber 3-*b* is formed inside the valve body 8-*a*. A hole that communicates the valve chamber 3-*b* with the inside of the valve cylinder 9 is formed in the valve body 8-*b*. In addition, a hole in communication with a low pressure chamber 4-*b* is formed in the valve body 8-*a*.

A valve spring (corresponding to a valve biasing member) 7 is housed in the valve chamber 3-*b*. In addition, a portion of a control valve element 6 is inserted into the valve spring 7. Further, due to the valve spring 7, the control valve element 6 is biased in an opposite direction from the injection hole 19 (upward direction). The control valve element 6 is slidably supported by the second valve body 8-*b* and a valve sliding surface 31 of the valve cylinder 9. The control valve element 6 is housed within the valve body 8 and the valve cylinder 9.

In addition, a middle chamber 23 is disposed inside the control valve element 6. The middle chamber 23 is a flow path in which fuel flows. The lower portion of the middle chamber 23 opens at the bottom edge portion of the control valve element 6, and is in communication with the inside of the valve cylinder 9. The upper portion of the control valve element 6 is connected to the valve chamber 3-*b* through an outer orifice 24. In other words, the control valve element 6 is able to connect the inside of the valve cylinder 9 with the valve chamber 3-*b* through the middle chamber 23 and the outer orifice 24. In addition, a gap is formed between the lower end portion of the control valve element 6 and the upper end portion of the large-diameter piston 12. Accordingly, the high pressure chamber 30 is connected to the control chamber 11 through the second communication passage 28.

A drive transmission pin 5 is inserted into the hole formed in the valve body 8-*a*. A gap is formed between the drive transmission pin 5 and the hole formed in the valve body 8-*a*. The lower end portion of the drive transmission pin 5 abuts the upper end portion of the control valve element 6. The upper end portion of the drive transmission pin 5 protrudes out from the valve body 8-*a*.

The actuator 2 is housed inside the injector body 1. The lower end portion of the actuator 2 is connected to a flange portion 2*a*. The flange portion 2*a* is abuttable with the drive transmission pin 5. According to the present embodiment, the actuator 2 is formed by stacking a great number of piezoelectric elements in a stack body (piezo elements).

Due to this configuration, when the actuator 2 is driven (extended), the flange portion 2*a* connect to the actuator 2 abuts the drive transmission pin 5, and due to this, the control valve element 6 is moved toward the needle 17.

The low pressure chamber (corresponding to a second chamber) 4-*b* is formed between the valve body 8-*a* and the flange portion 2*a* in the injector body 1. The low pressure chamber 4-*b* is in communication with a low pressure passage 4. For this reason, low pressure fuel (corresponding to fuel at a second pressure) stored in the low pressure chamber 4-*b* flow out from the low pressure chamber 4-*b* into the low pressure passage 4, and ultimately is discharged into the fuel tank.

The driver 33 includes an ECU (electronic control unit) 33-*a* and an EDU (electronic driving unit) 33-*b*. The ECU 33-*a* is primarily formed of a microcomputer (microprocessor) including a CPU, ROM, RAM, rewritable non-volatile memory such as flash memory, and an I/O interface.

The ECU 33-*a* performs control programs stored on the ROM or the flash memory based on signals received from a superior ECU. As a result, a variety of control processes for controlling the fuel injection valve 100 are performed. For example, the ECU 33-*a* outputs a control signal to the EDU-33*b* to control the extension and contraction of the actuator 2.

The EDU 33-*b* includes a high voltage generation circuit that generates a high voltage which is applied to the actuator 2. In addition, a plurality of switching elements included in the EDU 33-*b* are switched on and off based on injection signals, or control signals, from the ECU 33-*a* to control a power supply state to the actuator 2. As a result, the EDU 33-*b* controls the driving state of the actuator 2 based on the control signals output by the ECU 33-*a*.

According to conventional direct acting fuel injection valves, a large amount of driving energy may be needed to lift the needle 17, and the fuel injection pressure may be limited. In view of this, according to the present embodiment, the oil-tight chamber 16 is disposed between the lower end portion of the large-diameter piston 12, the nozzle body 15, and the needle 17. In addition, the control chamber 11 is disposed inside the large-diameter piston 12. In other words, the configuration of the fuel injection valve 100 is based on direct acting fuel injection valves, and at the same time, is also based on hydraulic-servo type fuel injection valves. The operation effects of this are shown below.

Figure 3:
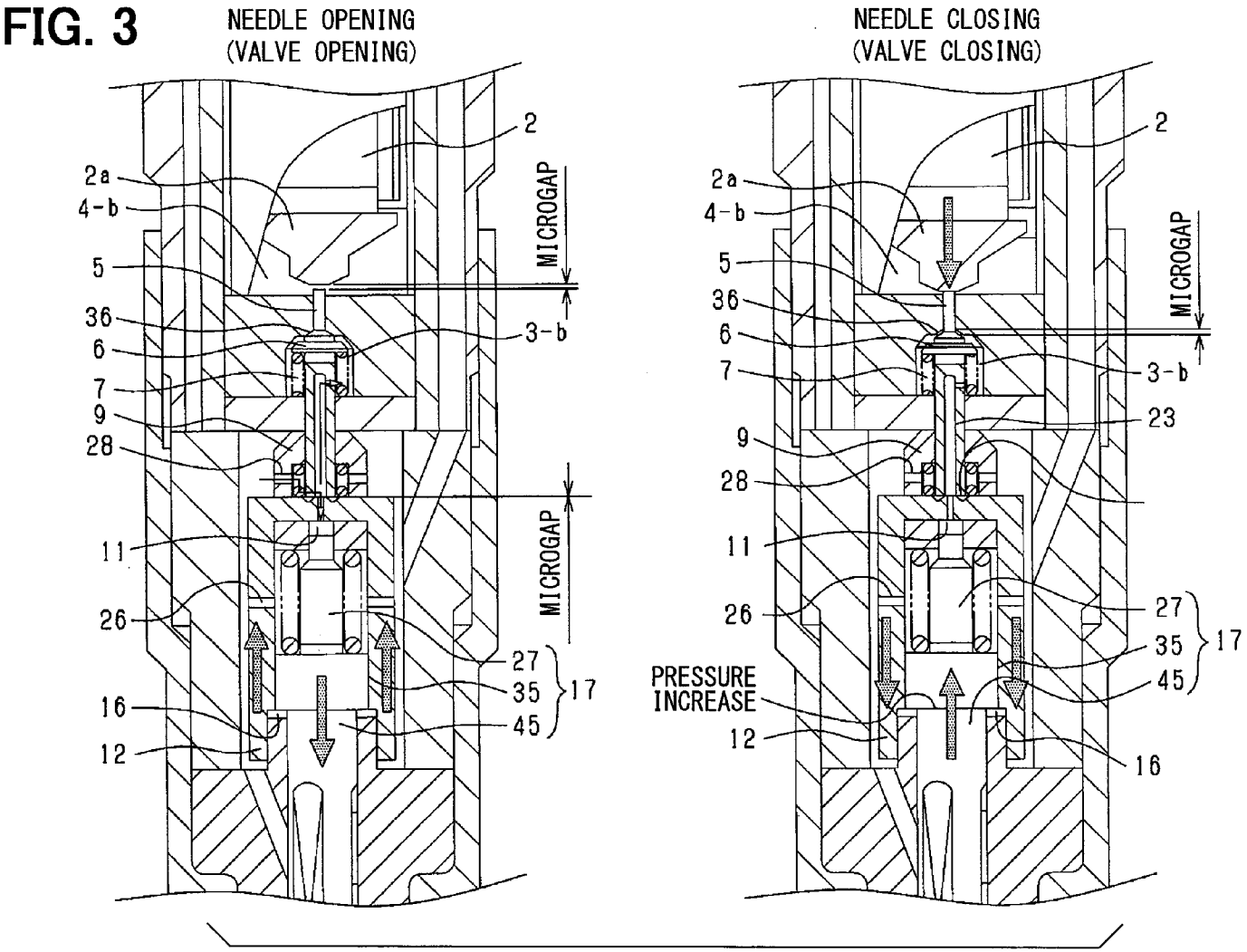
FIG. 3 is a view showing an operation of a fuel injection valve according to a present embodiment.

FIG. 3 shows the operation of each component when the needle 17 is open and closed. When the needle 17 is closed, the actuator 2 is not extended. Accordingly, a gap exists between the flange portion 2*a* connected to the actuator 2 and the drive transmission pin 5. In this state, a gap is formed between the large-diameter piston 12 and the control valve element 6. Accordingly, the high pressure fuel from the high pressure chamber 30 flows through the second communication passage 28 and flows into the control chamber 11 and the valve chamber 3-*b*. Due to this, the fuel pressure in the valve chamber 3-*b* increases, and a force is generated in the valve chamber 3-*b* that presses the control valve element 6 toward the actuator 2.

This force that presses the control valve element 6 toward the actuator 2 is greater than a force of the low pressure fuel stored in the low pressure chamber 4-*b* pressing the control valve element 6 toward the injection hole 19. Accordingly, the control valve element 6 is seated on a seat portion 36 of the valve chamber 3-*b*. Due to this, it is possible to close a gap between the control valve element 6 and the seat portion 36 which occurs when the control valve element 6 is not seated on the seat portion 36. At this time, the biasing force of the valve spring 7, which biases the control valve element 6 toward the actuator 2 (in the upward direction), is also applied to the control valve element 6. Accordingly, the responsiveness of seating the control valve element 6 on the seat portion 36 may be improved.

In other words, the fuel pressure in the valve chamber 3-*b* and the control chamber 11 becomes equal to the pressure of the high pressure fuel in the high pressure chamber 30. For example, regarding the control chamber 11 shown in FIG. 4, the section of the small-diameter piston portion 27 which receives the pressure of the fuel in the control chamber 11 has a projection area (control chamber area) Sctrl when projected in the movement direction of the needle 17. In addition, the portion of the needle 17 exposed to the injection hole 19 has a projection area (exposed area) Sseat when projected in the movement direction of the needle 17.

As a comparative example, it is assumed that the projection area Sctrl is set to be greater than the projection area Sseat. In this case, the portion of the needle 17 having applied the pressure of the high pressure fuel from below has a projection area, when projected in the movement direction of the needle 17, which is greater than the projection area Sctrl of the portion of the needle 17 having applied the pressure of the high pressure fuel from above. For this reason, when the pressure of the fuel in the control chamber 11 decreases, the force pressing the needle 17 toward the actuator 2 becomes greater than the force pressing the needle 17 toward the injection hole 19. As a result, there is a concern that the needle 17 may move, in a direction that causes fuel to be injected from the injection hole 19, without the force from the actuator 2 being transmitted through the fuel in the oil-tight chamber 16.

Figure 4:
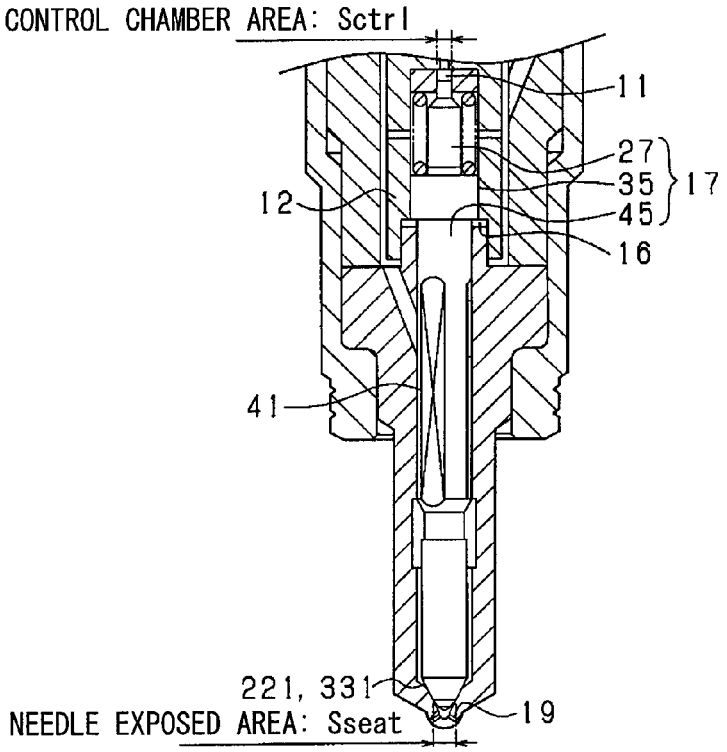
FIG. 4 is a view showing a relationship between an area of an exposed portion of a needle and an area of a control chamber according to a present embodiment.

As a countermeasure to this, according to the present embodiment, the control chamber area Sctrl is set to be smaller than the exposed area Sseat, as shown in FIG. 4. Due to this, it is possible to prevent the needle 17 from moving in a direction that causes fuel to be injected from the injection hole 19, until the force from the actuator 2 is transmitted through the fuel in the oil-tight chamber 16.

Returning to FIG. 3, due to the fuel pressure in the control chamber 11 increasing, the needle 17 is pressed toward the injection hole 19, and the seat surface 331 of the needle 17 seats on the seating surface 221. Along with this, the pressing portion 35 of the needle 17 presses on a portion of the oil-tight chamber 16. Due to the pressing portion 35 pressing on the fuel in the oil-tight chamber 16, the pressure of the fuel in the oil-tight chamber 16 is applied to the portion of the large-diameter piston 12 facing the oil-tight chamber 16. Accordingly, the large-diameter piston 12 is moved toward the actuator 2 (in the upward direction).

When opening the needle 17, the EDU 33-*b* supplies a driving voltage to the actuator 2 based on driving signals from the ECU 33-*a*. Due to this driving voltage, the actuator 2 extends. Accordingly, the flange portion 2*a* connected to the actuator 2 contacts the drive transmission pin 5, and the drive transmission pin 5 causes the control valve element 6 to contact the large-diameter piston 12. Since the control valve element 6 contacts the large-diameter piston 12, the connection between the control chamber 11 and the high pressure chamber 30 through the second communication passage 28 is cut off, and the control chamber 11 is connected to the middle chamber 23 disposed in the control valve element 6.

Meanwhile, since the drive transmission pin 5 is pushing into the control valve element 6, the control valve element 6 separates from the seat portion 36 of the valve chamber 3-*b*, and a gap exists between the seat portion 36 and the control valve element 6. Due to this, the middle chamber 23 in the control valve element 6, which is connected to the control chamber 11, is in communication with the low pressure chamber 4-*b* through the middle chamber 23. Accordingly, the high pressure fuel that flowed from the high pressure chamber 30 into the valve chamber 3-*b* when the actuator 2 was non-driven now flows out into the low pressure chamber 4-*b*. For this reason, the fuel pressure inside the valve chamber 3-*b* decreases, and the high pressure fuel stored in the control chamber 11 flows through the valve chamber 3-*b* and into the low pressure chamber 4-*b*. Accordingly, the fuel pressure inside the control chamber 11 decreases, and the pressure force exerted by the pressing portion 35 on the needle 17 toward the injection hole 19 decreases.

However, since the control chamber area Sctrl is smaller than the exposed area Sseat, even if the amount of force applied by the control chamber 11 on the needle 17 toward the injection hole 19 decreases as a result of the pressure reduction in the control chamber 11, this force is still greater than the amount of force urging the needle 17 to move in a direction that causes fuel to be injected from the injection hole 19. Accordingly, although the amount of force applied on the needle 17 toward the injection hole 19 decreases, the seat surface 331 of the needle 17 remains seated on the seating surface 231.

In this state, the control valve element 6 presses the large-diameter piston 12 toward the injection hole 19 as the actuator 2 extends. Accordingly, the fuel inside the oil-tight chamber 16, which is in contact with the large-diameter piston 12, is compressed. Then, the pressure of the fuel in the oil-tight chamber 16 is applied to the portion of the pressing portion 35 facing the oil-tight chamber 16, and the pressing portion 35 is moved toward the actuator 2 (upward direction). Accordingly, the needle 17 starts to lift (rise up).

Figure 5:
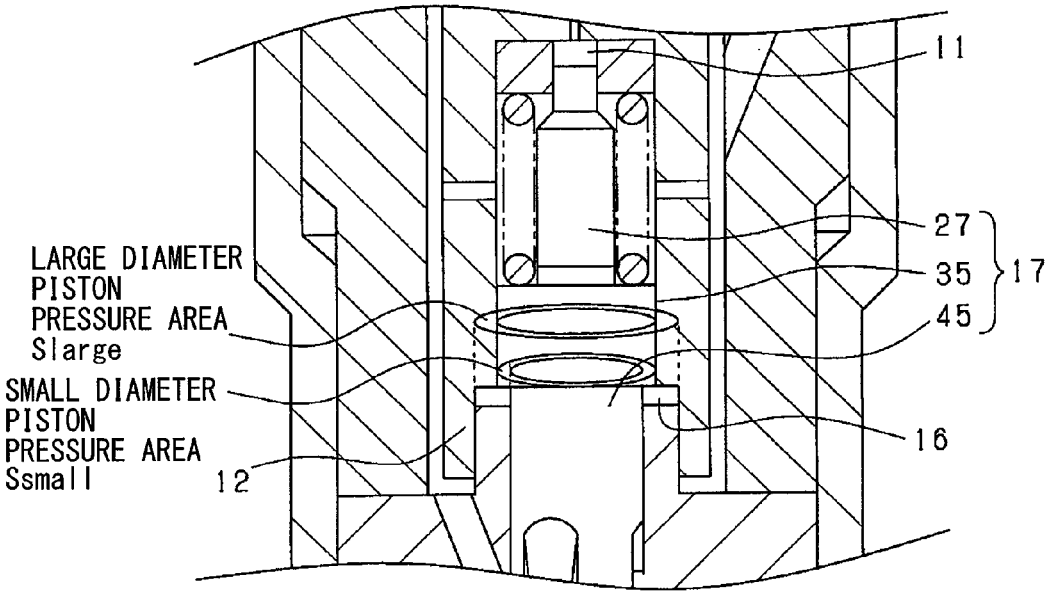
FIG. 5 is an enlarged cross sectional view around an oil-tight chamber of FIG. 1.

As shown in FIG. 5, according to the present embodiment, an area Slarge in which the large-diameter piston 12 presses against the fuel in the oil-tight chamber 16 is set to be greater than an area Ssmall in which the fuel in the oil-tight chamber 16 presses against the pressing portion 35. Due to this, when the large-diameter piston 12 presses the oil-tight chamber 16 by an amount of movement, in comparison, the pressing portion 35 is moved toward the actuator 2 by a greater amount of movement. Consequently, even if the actuator 2 only extends by a small amount, the needle 17 may be sufficiently moved in a direction that causes fuel to be injected from the injection hole 19.

Figure 6:
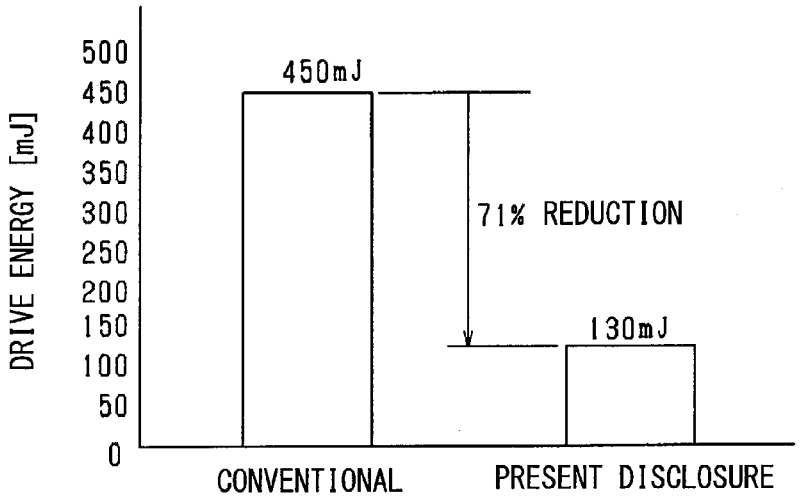
FIG. 6 is a view showing differences in drive energy between a present embodiment and a conventional example.

In this regard, according to the present embodiment, a direct acting force is generated on the needle 17 toward a direction that causes fuel to be injected from the injection hole 19. This direct acting force is generated while a force, which presses the needle 17 in a direction that causes fuel injection from the injection hole 19 to be stopped, is decreased. For this reason, as shown in FIG. 6, the energy needed to open the needle 17 is decreased as compared to a conventional direct acting fuel injection valve.

The ECU 33-*a* includes a plurality of charge control modes for charging the actuator 2. According to the present embodiment, these charge control modes include a direct acting assist mode (corresponding to a first charge control mode) and a hydraulic servo mode (corresponding to a second charge control mode) which have different charge energy timings. The charge energy timing is defined as when reaching a required amount of charge energy from the start of charging the actuator 2 until the needle 17 is moved in a direction that causes fuel to be injected from the injection hole 19.

Figure 7:
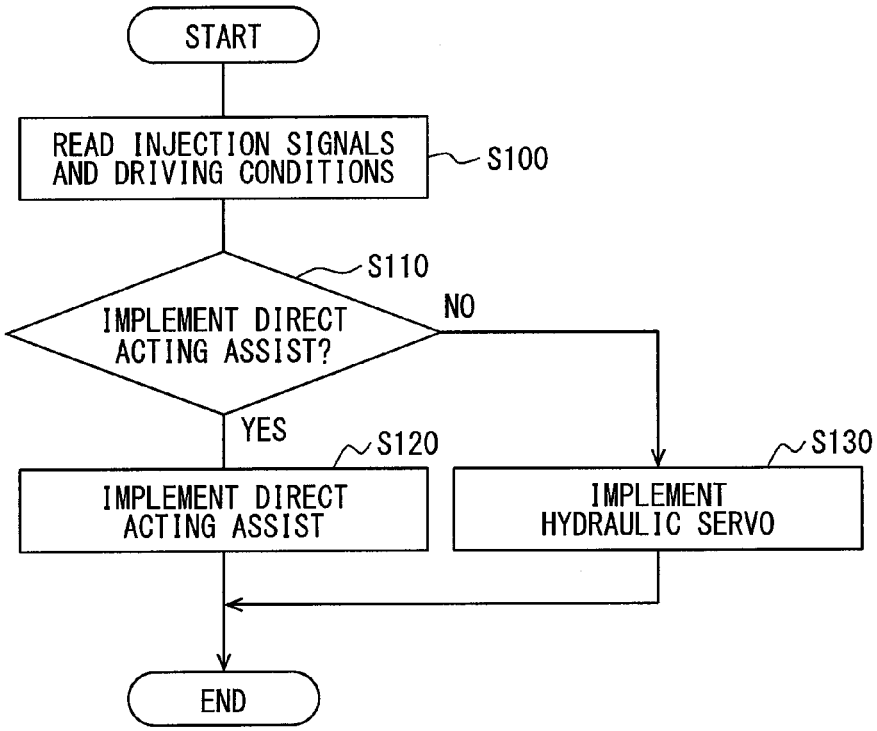
FIG. 7 is a control flowchart performed by an ECU according to a present embodiment.

Next, the control details of an injection rate waveform control process of the fuel injection valve 100 performed by the ECU 33-*a* will be explained with reference to FIG. 7. The injection rate waveform control process of the fuel injection valve 100 shown in FIG. 7 is repeatedly performed by the ECU 33-*a* with a fixed frequency while the ECU 33-*a* is powered on.

When the present control process begins, first at step S100, injection signals and driving conditions are received from a superior ECU and read. The injection signals include signals designating a fuel injection amount, an injection timing, an injection period, and an injection rate. These values depend on the driving conditions of the vehicle at the time. Specifically, the ECU 33-*a* obtains, from a superior ECU, an optimum fuel injection amount and fuel injection timing based on engine operation information such as engine rotation speed or accelerator angle. In addition, the fuel injection rate (valve opening degree) and the injection period are determined according to the injection amount and the fuel pressure in the common rail. The ECU 33-*a* receives all of these values from the superior ECU.

At step S110, it is determined whether the direct acting assist mode should be implemented, according to the injection signals received at step S100. Specifically, when the injection signals designate a (high rectangle) injection rate having a rising rate greater than a predetermined value, the direct acting assist mode is implemented. Conversely, when the injection signals designate a (low rectangle) injection rate having a rising rate lower than a predetermined value, the hydraulic servo mode is implemented.

When it is determined that the direct acting assist mode should be implemented (S110: YES), the process continues to step S120, the direct acting assist mode is implemented, and the present control process ends. When it is determined that the direct acting assist mode should not be implemented (S110: NO), the process continues to step S130, the hydraulic servo mode is implemented, and the present control process ends.

Next, the operations of the direct acting assist mode and the hydraulic servo mode will be explained with reference to FIG. 8. In addition, here, the charging period of the actuator 2 is fixed for both the direct acting assist mode and the hydraulic servo mode.

Figure 8:
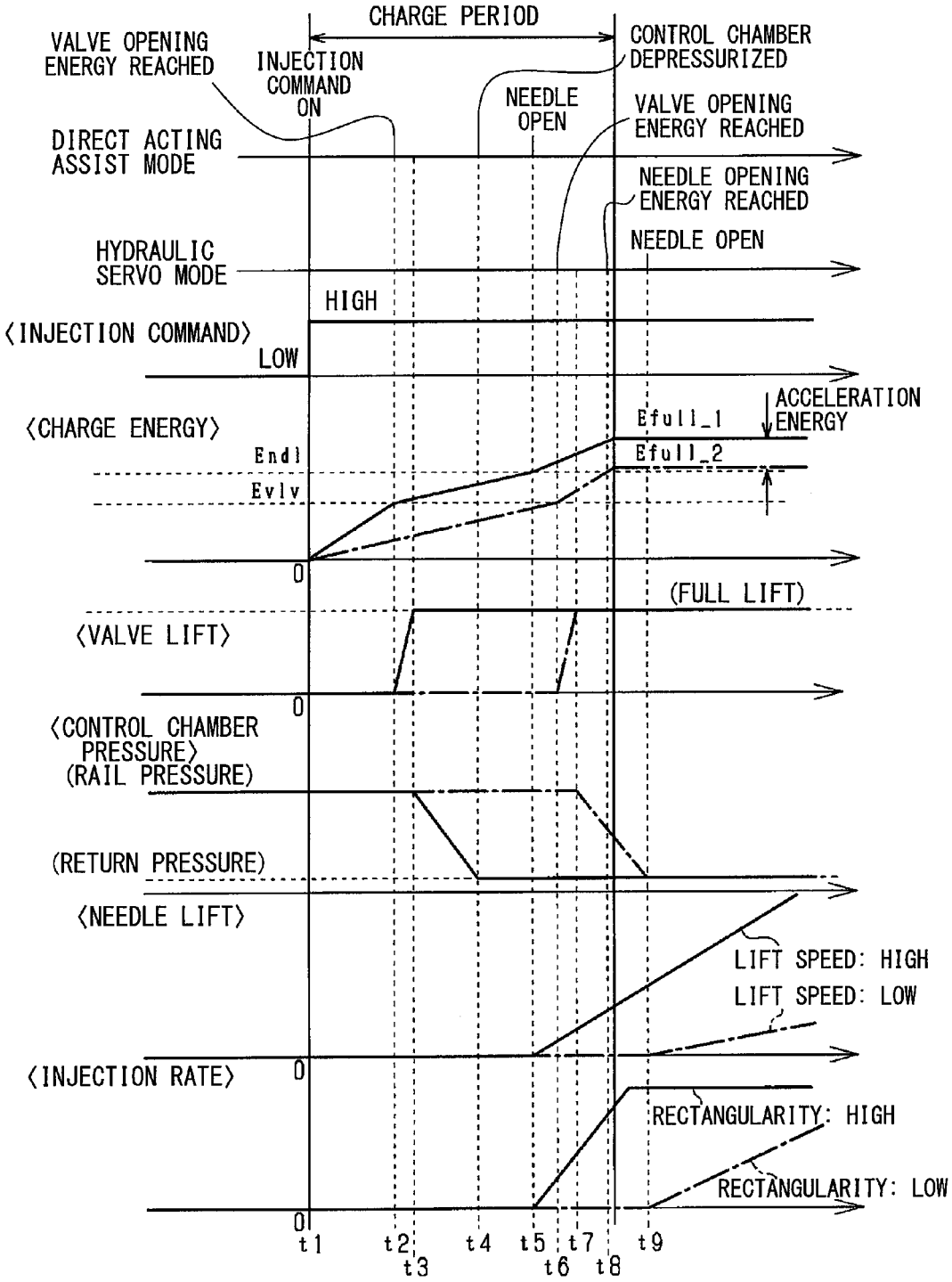
FIG. 8 is a timing chart showing charge energy, valve lift, control chamber pressure, injection rate and the like according to a present embodiment.

In FIG. 8, "injection command" uses high/low to represent whether injection signals, which command that a fuel injection be performed, are received. "Charge energy" refers to the amount of energy charged to the actuator 2. "Valve lift" refers to how much the control valve element 6 has lifted. "Control chamber pressure" is the fuel pressure in the control chamber 11. "Needle lift" refer to how much the needle 17 has lifted. "Injection rate" refers to the injection rate of fuel injected from the fuel injection valve 100.

According to the present embodiment, the needle 17 begins to move in a direction that causes fuel to be injected from the injection hole 19 (i.e., rise up) when two conditions are satisfied: when the charge energy accumulated in the actuator 2 reaches a needle opening energy Endl, and when the fuel pressure in the control chamber 11 falls to a return pressure.

First, the direct acting assist mode will be explained. When the injection command switches from low to high (refer to time t1), the actuator 2 begins to be charged. When the charge energy to the actuator 2 reaches a valve opening energy (corresponding to a connection operation energy) Evlv, the control valve element 6 begins to descend due to the actuator 2 extending (refer to time t2). Then, when the control valve element 6 completes the descent, the middle chamber 23 disposed in the control valve element 6 is connected to the control chamber 11, and the connection between the control chamber 11 and the high pressure chamber 30 is cut off (refer to time t3). Due to this, the high pressure fuel stored in the control chamber 11 is discharged through the middle chamber 23 and the valve chamber 3-*b* into the low pressure chamber 4-*b*, and the pressure in the control chamber 11 begins to decrease. Then, after time passes, the pressure in the control chamber 11 decreases to reach a return pressure (corresponding to a predetermined pressure) and finishes decreasing (refer to time t4).

Figure 9:
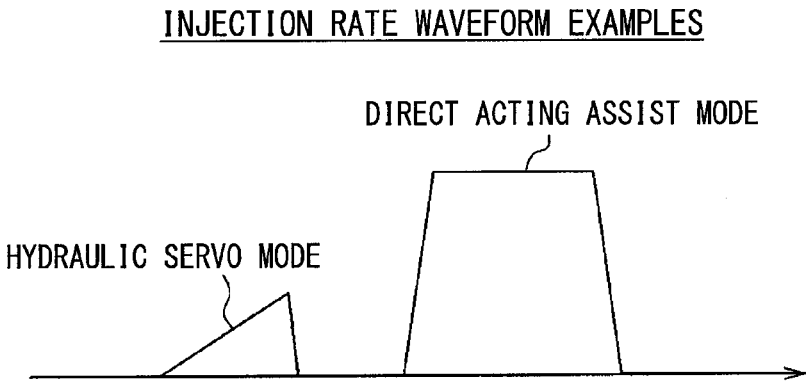
FIG. 9 is a view showing examples of injection rate waveforms according to charge control modes according to a present embodiment.

Next, when the charge energy to the actuator 2 reaches the needle opening energy Endl (refer to time t5), the needle 17 moves in a direction that causes fuel to be injected from the injection hole 19 (i.e., rise up). At this time, since the charge period has not finished, the charge energy to the actuator 2 continues to increase, and as a result, the rate of rise of the needle 17 also increases. FIG. 9 shows a specific example of the degree of rectangularity in the direct acting assist mode. An injection during the direct acting assist mode may be applied to, for example, a main injection.

Next, the hydraulic servo mode will be explained. When the injection command changes from low to high (refer to time t1), the actuator 2 begins to be charged. Then, when the charge energy to the actuator 2 reaches the valve opening energy Evlv, the control valve element 6 begins to descend due to the actuator 2 extending (refer to time t6). Then, when the control valve element 6 completes the descent, the pressure in the control chamber 11 begins to decrease (refer to time t7).

After the charge energy to the actuator 2 reaches the valve opening energy Evlv and before the charge period ends, the charge rate is increased such that the charge energy to the actuator 2 reaches the needle opening energy Endl (refer to time t6 to t8). At this time, even if the energy to the actuator 2 reaches the needle opening energy Endl, the fuel pressure of the control chamber 11 has not fallen to the return pressure, and therefore the needle 17 has not begun to rise (refer to time t8). Then, when the fuel pressure of the control chamber 11 completes falling to the return pressure, the needle 17 begins to rise (refer to time t9). At this time, the final charge energy of the actuator 2 charged in the end is less than the final charge energy in the direct acting assist mode. Accordingly, the rate of rise of the needle 17 is slower than in the direct acting assist mode, and the rectangularity of the injection rate is also lower. FIG. 9 shows a specific example of the degree of rectangularity in the hydraulic servo mode. An injection during the hydraulic servo mode may be applied to, for example, a pilot injection.

In the direct acting assist mode, a valve opening energy timing (corresponding to a connection operation energy timing), which is when the charge energy to the actuator 2 reaches the valve opening energy Evlv, is set to be earlier than the valve opening energy timing in the hydraulic servo mode. Since the depressurization rate in the control chamber 11 is the same for either mode, the fuel pressure in the control chamber 11 completes depressurization at an earlier timing in the direct acting assist mode (refer to time t4) than when the fuel pressure in the control chamber 11 completes depressurization in the hydraulic servo mode (refer to time t9).

Due to the above configuration, the fuel injection valve 100 and the ECU 33-*a* of the present embodiment exhibits the following effects.

When the actuator 2 is in an extended state, the fuel stored in the control chamber 11 is expelled through the control valve element 6 into the low pressure chamber 4-*b*, and the pressure control chamber 11 depressurizes. For this reason, the amount of force pressing the needle 17 in a direction that stops fuel injection from the injection hole 19 decreases. In this state, as the actuator 2 extends, a displacement force is generated on the control valve element 6. Due to the large-diameter piston 12, this displacement force is transmitted as a force that urges the needle 17 in a direction that causes fuel to be injected from the injection hole 19.

Accordingly, since the amount of force pressing the needle 17 in a direction that stops fuel injection from the injection hole 19 decreases due to the depressurization of the control chamber 11, the force transmitted from the large-diameter piston 12 to the needle 17 in a direction that causes fuel to be injected from the injection hole 19 may be smaller than as conventional. As a result, the advantages of direct acting fuel injection valves are gained, while the amount of charge energy to the actuator 2 needed to cause the needle 17 to lift is reduced, and the fuel injection pressure may be easily increased.

The section of the small-diameter piston portion 27 of the needle 17 which receives the pressure of the fuel in the control chamber 11 has a projection area Sctrl when projected in the movement direction of the needle 17. Further, the portion of the needle 17 exposed to the injection hole 19 has a projection area Sseat when projected in the movement direction of the needle 17. Here, Sctrl is set to be smaller than Sseat. For this reason, even if the pressure of the fuel in the control chamber 11 decreases, a force is applied to the needle 17 in a direction that stops fuel injection from the injection hole 19, and the needle 17 may be suppressed from rising.

The control valve element 6 is biased toward the low pressure chamber 4-*b* by the valve spring 7. Accordingly, by biasing the control valve element 6 toward the low pressure chamber 4-*b*, it is possible to improve the responsiveness and operation stability of cutting off the connection between the low-pressure chamber 4-*b* and the valve chamber 3-*b* by the control valve element 6. In addition, when the actuator 2 is not driven, by biasing the control valve element 6 toward the low pressure chamber 4-*b*, it is possible reliably maintain the connection between the low-pressure chamber 4-*b* and the valve chamber 3-*b* in a blocked state.

Due to the common orifice 25, an amount of fuel flowing into the control chamber 11 is regulated, and an amount of fuel flowing out of the control chamber 11 is regulated. Accordingly, as compared to a fuel injection valve 100 which does not include the common orifice, the rate of increase and decrease of pressure in the control chamber 11 may be regulated. As such, it is possible to regulate the lift speed of the needle 17.

Due to the outer orifice 24, an amount of fuel flowing from the control chamber 11 through the middle chamber 23 and out into the valve chamber 3-*b* is regulated. Accordingly, for example by regulating the fuel flow amount to be less as compared to a fuel supply rate supplied from the high pressure chamber 30, it is possible to reduce the depressurization rate of the control chamber 11, and thus more easily perform a fuel injection with a rectangular injection rate.

Along with the valve body 8, the substantially cylindrical valve cylinder 9 is disposed so as to separate the control valve element 6 from the high pressure chamber 30. Accordingly, a pressure is applied by the high pressure chamber 30 on the outer circumferential surface of the valve cylinder 9. As a result, due to the pressure applied on the outer circumferential surface of the valve cylinder 9, a gap between the valve cylinder 9 and the control valve element 6 is suppressed from increasing. As such, when the fuel pressure in the valve chamber 3-*b* decreases, it is possible to suppress increases in a leak rate of fuel in the valve cylinder 9 leaking into the valve chamber 3-*b*.

Due to the cylinder spring 20, the valve cylinder 9 is biased toward the actuator 2. Accordingly, when the actuator 2 is driven, it is easier to cut off the high pressure chamber 30 and the valve chamber 3-*b*.

The oil-tight chamber 16 is formed by a space defined by the portion of the needle 17 around the lower end of the pressing portion 35, the lower portion of the large-diameter piston 12, and the portion of the nozzle body 15 which protrudes into the lower body 10. Due to such a configuration, the driving force of the actuator 2 is transmitted through the fuel in the oil-tight chamber 16 to the large-diameter piston 12, and it is possible to cause the needle 17 to lift.

The area Slarge in which the large-diameter piston 12 presses against the fuel in the oil-tight chamber 16 is set to be greater than the area Ssmall in which the fuel in the oil-tight chamber 16 presses against the pressing portion 35. For this reason, the lift amount of the needle 17 may be greater than the extension amount of the actuator 2.

The actuator 2 is formed of piezo elements. Accordingly, as compared to magnetostrictors or the like, responsiveness may be increased and the actuator 2 may be formed in a compact manner.

The ECU 33-*a* includes two charge control modes for charging the actuator 2. Of these, in the direct acting assist mode, the charge energy timing is set to be later than when the fuel pressure of the control chamber 11 reaches the return pressure (depressurization completion timing). The needle 17 moves in a direction that causes fuel to be injected from the injection hole 19 when both conditions of charge energy accumulated in the actuator 2 and pressure in the control chamber 11 are satisfied.

Accordingly, at the time of the charge energy timing, the needle 17 may be moved in a direction that causes fuel to be injected from the injection hole 19. Further, in the hydraulic servo mode, the charge energy timing is set to be earlier than the depressurization completion timing. Accordingly, at the time of the depressurization completion timing, the needle 17 may be moved in a direction that causes fuel to be injected from the injection hole 19.

The direct acting assist mode is set such that the final charge is greater than in the hydraulic servo mode. For this reason, in the direct acting assist mode, the force causing the needle 17 to be moved in a direction that causes fuel to be injected from the injection hole 19 is greater than in the hydraulic servo mode. Accordingly, in the direct acting assist mode, a fuel injection may be performed with a more rectangular injection rate than in the hydraulic servo mode.

In the direct acting assist mode, the valve opening energy timing is set to be earlier than the valve opening energy timing in the hydraulic servo mode. By reducing the amount of time until reaching the valve opening energy Evlv, the control chamber 11 may be depressurized earlier by this difference.

In addition, the above described embodiment may be modified and implemented as follows.

The actuator 2 is formed of piezo elements. Alternatively, the actuator 2 may be formed of, for example, magnetostrictors.

In the above described embodiment, due to the cylinder spring 20, the valve cylinder 9 is biased toward the actuator 2. Alternatively, the cylinder spring 20 may be not provided. In this case as well, when the actuator 2 is driven, the control chamber 11 may be depressurized.

In the above described embodiment, due to the valve spring 7, the control valve element 6 is biased toward the low pressure chamber 4-*b*. Alternatively, the valve spring 7 may be not provided. In this case as well, due to the high pressure fuel from the high pressure chamber 30 flowing through the middle chamber 23 and into the valve chamber 3-*b*, a closing force may be applied on the control valve element 6.

The section of the small-diameter piston portion 27 of the needle 17 which receives the pressure of the fuel in the control chamber 11 has a projection area Sctrl when projected in the movement direction of the needle 17. Further, the portion of the needle 17 exposed to the injection hole 19 has a projection area Sseat when projected in the movement direction of the needle 17. Here, Sctrl is set to be smaller than Sseat. Alternatively, the projection area Sctrl may be set to be equal to the projection area Sseat. In this case as well, if the large-diameter piston 12 is not pressed by the control valve element 6, the needle 17 is not moved in a direction that causes fuel to be injected from the injection hole 19. Alternatively, the projection area Sctrl may be set to be greater than the projection area Sseat. In this case, while there is a concern that the needle 17 may open due to the control chamber depressurizing, the amount of energy required to charge the actuator 2 to cause the needle 17 to lift may be further reduced.

The common orifice 25, which regulates the inflow and outflow amounts of fuel, is disposed in the large-diameter piston 12. Alternatively, the common orifice 25 may be not provided, and instead a passage with about the same cross sectional area as the middle-chamber 23 may be used. In this case as well, by controlling the magnitude of the charge energy ultimately charged to the actuator 2, the lift speed of the needle 17 may be controlled.

The outer orifice 24, which regulates the fuel flowing in the middle chamber 23, is disposed in the control valve element 6. Alternatively, without providing the outer orifice 24, a passage with about the same cross sectional area as the middle chamber 23 may be used instead. In this case as well, by controlling the magnitude of the charge energy ultimately charged to the actuator 2, the rising angle of the injection rate may be regulated downward.

The area Slarge in which the large-diameter piston 12 presses against the fuel in the oil-tight chamber 16 is set to be greater than the area Ssmall in which the fuel in the oil-tight chamber 16 presses against the pressing portion 35. Alternatively, for example, the area Slarge in which the large-diameter piston 12 presses against the fuel in the oil-tight chamber 16 may be set to be equal to, or smaller than, the area Ssmall in which the fuel in the oil-tight chamber 16 presses against the pressing portion 35. In this case, the amount of force that the pressing portion 35 is pressed by the fuel in the oil-tight chamber 16 (in other words, a force causing the needle 17 to move in a direction that opens the injection hole 19) may be increased. In other words, the force that the actuator 2 needs to drive the large-diameter piston 12 with may be reduced.

The ECU 33-*a* includes the direct acting assist mode and the hydraulic servo mode which have different charge energy timings. The charge energy timing is defined as when reaching a required amount of charge energy from the start of charging the actuator 2 until the needle 17 is moved in a direction that causes fuel to be injected from the injection hole 19. Alternatively, the ECU 33-*a* may include charge control modes other than these.

In both the direct acting assist mode and the hydraulic servo mode, the actuator 2 is charged for a fixed period. Alternatively, the actuator 2 may be charged for different periods of time in the direct acting assist mode and the hydraulic servo mode, as long as that the amount of charge energy ultimately charged to the actuator 2 is greater in the direct acting assist mode than in the hydraulic servo mode.

In the direct acting assist mode, the valve opening energy timing is set to be earlier than the valve opening energy timing in the hydraulic servo mode. Alternatively, the valve opening energy timing in the direct acting assist mode may be later than the valve opening energy timing in the hydraulic servo mode, as long as that the amount of charge energy ultimately charged to the actuator 2 is greater in the direct acting assist mode than in the hydraulic servo mode.

In the above described embodiment, the configuration which presses the needle 17 through the fuel in the oil-tight chamber 16 may be replaced by disposing a lever member in the high pressure chamber 30 directly below the large-diameter piston 12 and the pressing portion 35. In this case, when the actuator 2 is driven, the control valve element 6 presses the large-diameter piston 12 toward the needle 17. Due to this, the large-diameter piston 12 presses one end of the level member, and through lever action, the other end of the lever member lifts the pressing portion 35 up toward the actuator 2. Accordingly, the needle 17 may be moved in a direction that causes fuel to be injected from the injection hole 19.

In the above described embodiment, the valve spring 7, the nozzle spring 14, and the cylinder spring 20 are formed by springs (e.g., coil), but alternatively, may be formed by other elastic members (e.g., rubber).

When the needle 17 is moved in a direction that causes fuel to be injected from the injection hole 19, this movement amount may be designed to be greater than a first predetermined amount which is set to be lower than a maximum movement amount, such that the end surface of the small-diameter piston portion 27 toward the actuator 2 abuts an inner surface of the large-diameter piston 12 that faces this end surface. Due to such a design, once the end surface of the small-diameter piston portion 27 toward the actuator 2 abuts the inner surface of the large-diameter piston 12 that faces this end surface, then the driving force of the actuator 2 is directly transmitted through the large-diameter piston 12 to the needle 17. In other words, by controlling the extension and contraction of the actuator 2, the movement of the needle 17 may be controlled.

According to the present modified example, the control valve element 6 moves toward the needle 17 or toward the actuator 2 in accordance with the extension and contraction of the actuator 2. During this movement, there is a concern that there may be a period during which the low pressure chamber 4-*b* and the high pressure chamber 30 are communicated through the valve chamber 3-*b*, such that the fuel in the high pressure chamber 30 flows into the low pressure chamber 4-*b* (hereinafter, referred to as a switching leak). This is especially a concern when performing multi-stage injections, in which the low pressure chamber 4-*b* and the high pressure chamber 30 may be communicated through the valve chamber 3-*b* over many periods, resulting in a large switching leak.

However, when performing a multi-stage injection, during the first stage injection, the needle 17 is moved toward the actuator 2 by depressurizing the fuel pressure in the control chamber 11. Then, once the needle 17 exceeds the first predetermined amount, the end surface of the small-diameter piston portion 27 toward the actuator 2 abuts the inner surface of the large-diameter piston 12 that faces this end surface. Thereafter, each fuel injection aside from the final injection is performed while maintaining this abutment, such that the movement amount of the needle 17 is directly controlled through the large-diameter piston 12 by the extension and contraction driving of the actuator 2. During the last stage injection, the fuel pressure in the control chamber 11 is increased, and the needle 17 is moved toward the injection hole 19.

Accordingly, during each fuel injection except the first injection and the final injection, the end surface of the needle 17 toward the actuator 2 is maintained in a state of abutting the large-diameter piston 12 due to the actuator 2 pressing on the control valve element 6. During this period, the low-pressure chamber 4*b*, the valve chamber 3-*b*, and the control chamber 11 are connected, and the high pressure chamber 30 is cut off from the control chamber 11. Accordingly, it is possible to greatly suppress switching leaks.

Figure 10:
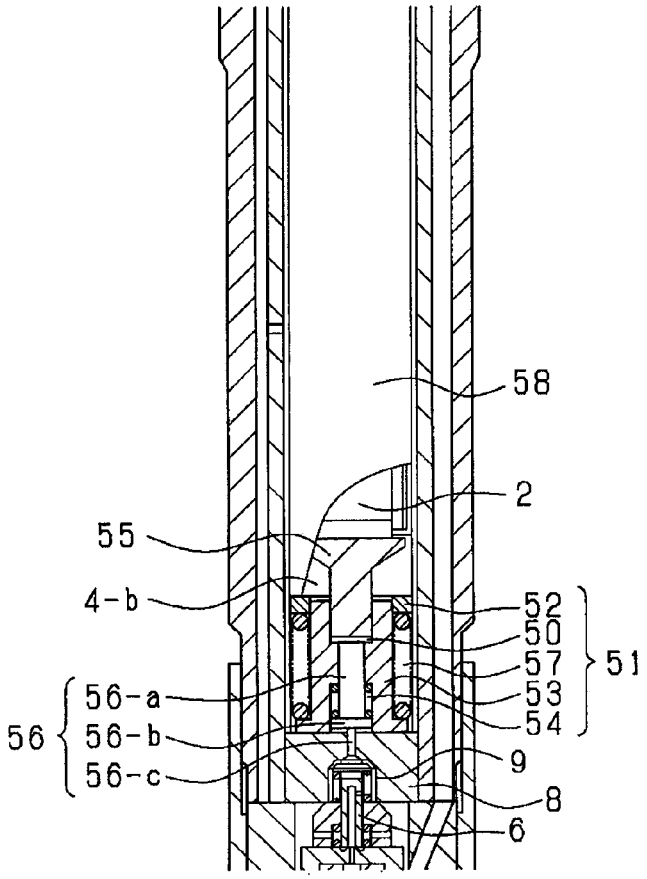
FIG. 10 is a cross sectional view of a fuel injection valve according to a modified example.

In the above described embodiment, the flange portion 2*a* is connected to the lower end portion of the actuator 2, and the lower end portion of the flange portion 2*a* is able to contact the drive transmission pin 5. Alternatively, as shown in FIG. 10, a displacement amplification chamber 50 may be further formed between the flange portion 2*a* and the drive transmission pin 5.

This configuration will be described in detail. A flange portion 55 (corresponding to a large-diameter pin) is connected to the lower end portion of the actuator 2. The low pressure chamber 4-*b* is formed between the flange portion 55 and the valve body 8 which houses the valve cylinder 9. A displacement amplification mechanism 51 is disposed in the low pressure chamber 4-*b*. The displacement amplification mechanism 51 includes a fixed member 52, a support cylinder 53, a pin spring 54, and a second cylinder spring 57.

The support cylinder 53 is disposed above the valve body 8. The upper portion of the support cylinder 53 is able to slidably support the lower portion of the flange portion 55, which is connected to the lower end portion of the actuator 2. In addition, the lower portion of the support cylinder 53 is able to slidably support a portion including the upper end portion of a drive transmission pin 56. The upper end portion of the support cylinder 53 is slidably supported by the fixed member 52. The upper end surface of the fixed member 52 abuts a housing member 58 that houses the entirety of the actuator 2. the second cylinder spring 57 is disposed on the outer periphery of the support cylinder 53. The upper end of the second cylinder spring 57 abuts the fixed member 52, and in this state, the second cylinder spring 57 biases the support cylinder 53 in a direction such that the lower end of the support cylinder 53 abuts the valve body 8.

The drive transmission pin 56 acts as a valve element contact pin, and includes a mid-diameter portion 56-*a*, a large-diameter portion 56-*b*, and a small-diameter portion 56-*c*.

The mid-diameter portion 56-*a* includes the upper end portion of the drive transmission pin 56, and the lower end portion of the mid-diameter portion 56-*a* is coupled to the upper end portion of the large-diameter portion 56-*b*. Further, the outer diameter of the mid-diameter portion 56-*a* is smaller than the outer diameter of the flange portion 55 lower portion. The support cylinder 53 slidably supports a portion including the upper end portion of the mid-diameter portion 56-*a*.

The upper end portion of the large-diameter portion 56-*b* is coupled to the lower end portion of the mid-diameter portion 56-*a*, and the lower end portion of the large-diameter portion 56-*b* is coupled to the upper end portion of the small-diameter portion 56-*c*. Further, the outer diameter of the large-diameter portion 56-*b* is greater than the outer diameters of the mid-diameter portion 56-*a* and the small-diameter portion 56-*c*. Specifically, the outer diameter of the large-diameter portion 56-*b* is equal to the outer diameter of the flange portion 55 lower portion. The large-diameter portion 56-*b* is slidably supported by the support cylinder 53.

The upper end portion of the small-diameter portion 56-*c* is coupled to the lower end portion of the large-diameter portion 56-*b*. Further, the outer diameter of the small-diameter portion 56-*c* is smaller than the outer diameter of the mid-diameter portion 56-*a*. The lower end portion of the small-diameter portion 56-*c* is inserted into the valve body 8, and is abuttable with the upper end portion of the control valve element 6.

The support cylinder 53 slidably supports a portion including the upper end portion of the mid-diameter portion 56-*a*. Accordingly, the middle portion of the support cylinder 53 has a smaller inner diameter than the upper and lower portions thereof. At this time, a space is formed by the upper end portion of the large-diameter portion 56-*b*, the outer circumferential surface of the mid-diameter portion 56-*a*, and the inner circumferential surface of the lower portion of the support cylinder 53. The pin spring 54 is disposed in the formed spaced. Due to this pin spring 54, the transmission drive pin 56 is biased toward the injection hole 19.

The lower end portion of the flange portion 55 faces toward the upper end portion of the drive transmission pin 56. In addition, the displacement amplification chamber 50 is formed as a space defined by the lower end portion of the flange portion 55, the upper end portion of the drive transmission pin 56 (i.e., the upper end portion of the mid-diameter portion 56-*a*), and the inner circumferential surface of the upper portion of the support cylinder 53. At this time, due to the relationship between the outer diameter of the lower end portion of the flange portion 55 and the outer diameter of the mid-diameter portion 56-*a*, an area in which the flange portion 55 presses against fuel in the displacement amplification chamber 50 is greater than an area in which the fuel in the displacement amplification chamber 50 presses against the drive transmission pin 56.

According to the above described configuration, the area in which the flange portion 55 presses against the fuel in the displacement amplification chamber 50 is designed to be greater than the area in which the fuel in the displacement amplification chamber 50 presses against the drive transmission pin 56. For this reason, according to Pascal's theorem, when the driving force of the actuator 2 is transmitted through the fuel in the displacement amplification chamber 50 to the drive transmission pin 56, the displacement amount of the drive transmission pin 56 may be greater than the extension amount of the actuator 2. The displacement amplification mechanism 51 and the flange portion 55 thus together act as an increase mechanism that increases a displacement amount by which the control valve element 6 is displaced due to the actuator 2 extending.

Figure 11:
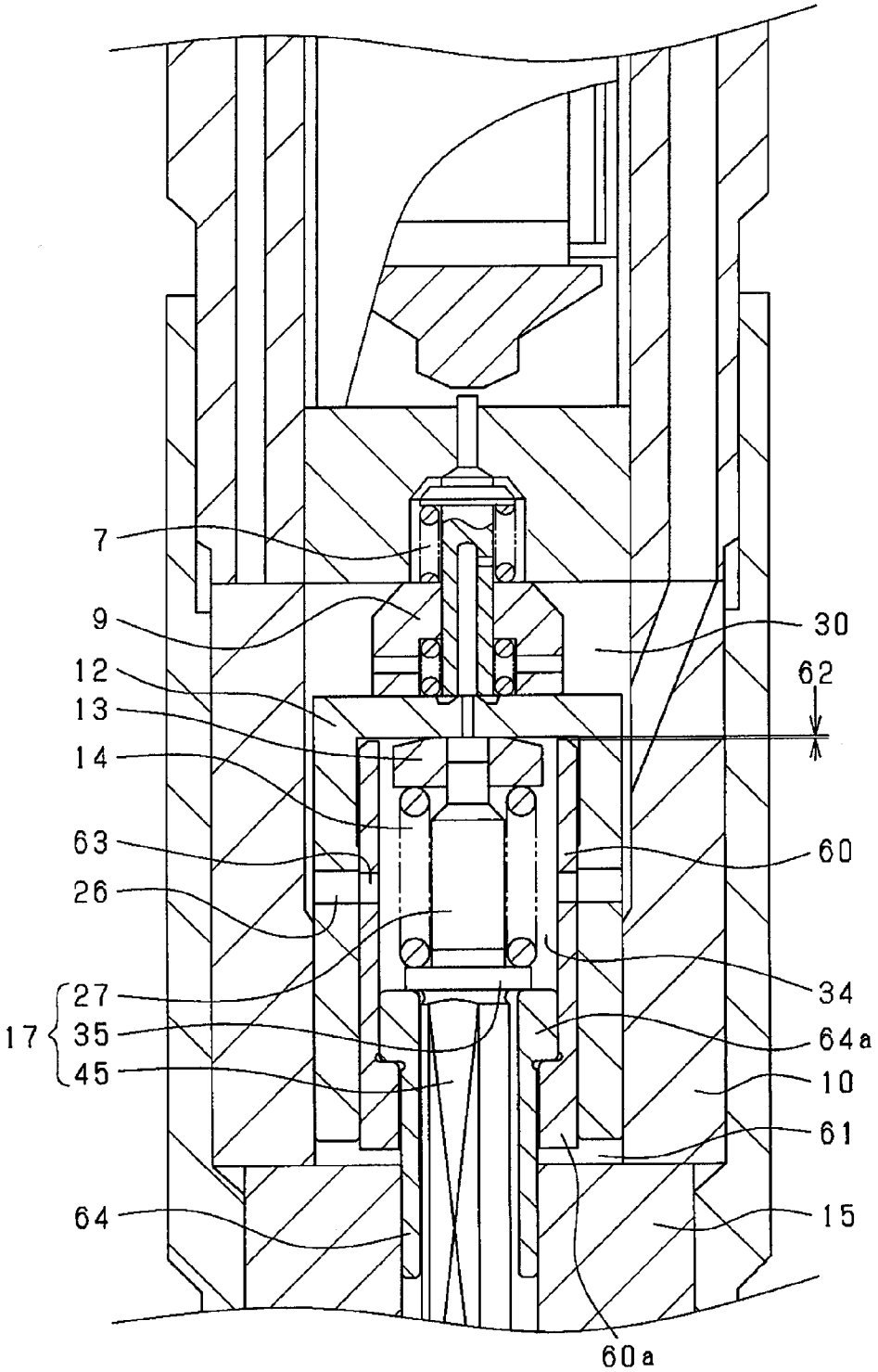
FIG. 11 is a cross sectional view of a fuel injection valve according to a modified example.

In the above described embodiment, the pressing chamber 34 is formed in the large-diameter piston 12, and the pressing chamber 34 houses a portion of the needle 17. Alternatively, as shown in FIG. 11, in addition to housing a portion of the needle 17, the pressing chamber 34 may house a second cylinder 60.

The configuration of the needle 17 is based on the above described embodiment. Specifically, the small-diameter piston portion 27 is inserted into the nozzle spring 14 which is housed within the pressing chamber 34. The lower end portion of the small-diameter piston portion 27 is coupled to the upper end portion of the pressing portion 35, and the lower end portion of the pressing portion 35 is coupled to the circular column portion 45.

In the present modified example, the lower end portion of the pressing portion 35 abuts the upper end portion of an abutment member 64. The abutment member 64 is disposed so as to surround the circular column portion 45. The lower end portion of the abutment member 64 is inserted into the nozzle body 15.

The second cylinder 60 is housed in the pressing chamber 34 so as to surround the needle 17. An annular protrusion portion 60*a* that protrudes toward the circular column portion 45 is formed at the inner circumferential surface of the lower portion of the second cylinder 60.

Meanwhile, an annular protrusion portion 64*a* that protrudes toward the second cylinder 60 is formed at the inner circumferential surface of the lower portion of the abutment member 64. Accordingly, when the needle 17 is preventing fuel injection from the injection hole 19 (i.e., when the seat surface 331 of the needle 17 is seated on the seating surface 221), the protrusion portion 64*a* of the abutment member 64 faces the protrusion portion 60*a* of the second cylinder 60 in the axial direction of the needle 17. A gap is formed between the inner circumferential surface of the protrusion portion 60*a* of the second cylinder 60 and the outer circumferential surface of the abutment member 64.

An oil-tight chamber 61 is defined by the lower body 10, the lower portion of the large-diameter piston 12, the lower portion of the second cylinder 60, the abutment member 64, and the upper end of the nozzle body 15. Further, when the actuator 2 is in a contracted state, the second cylinder 60 is pressed by the abutment member 64 toward the injection hole 19, and a first gap 62 is formed between an end portion of the second cylinder 60 toward the actuator 2 and a surface of the large-diameter piston 12 that faces this end portion.

The first communication passage 26 is disposed in the large-diameter piston 12 such that high pressure fuel flows in from the high pressure chamber 30. A third communication passage 63 is disposed in the second cylinder 60 such that fuel is able to flow in through the first communication passage 26. When configured in this manner, by connecting the first communication passage 26 with the third communication passage 63, fuel from the high pressure chamber 30 flows into the pressing chamber 34.

According to the present modified example, when the actuator 2 is in a contracted state, the first gap 62 exists between an end portion of the second cylinder 60 toward the actuator 2 and the surface of the large-diameter piston 12 that faces this end portion. Accordingly, as shown on the left in FIG. 12, when the actuator 2 extends, the driving force of the actuator 2 is transmitted by the large-diameter piston 12 through the fuel in the oil-tight chamber 61 to the second cylinder 60. As a result, the second cylinder 60 is moved, together with the needle 17, toward the actuator 2 until the first gap 62 is closed. At this time, the protrusion portion 64*a* of the abutment member 64 is abutting the protrusion portion 60*a* of the second cylinder 60.

Figure 12:
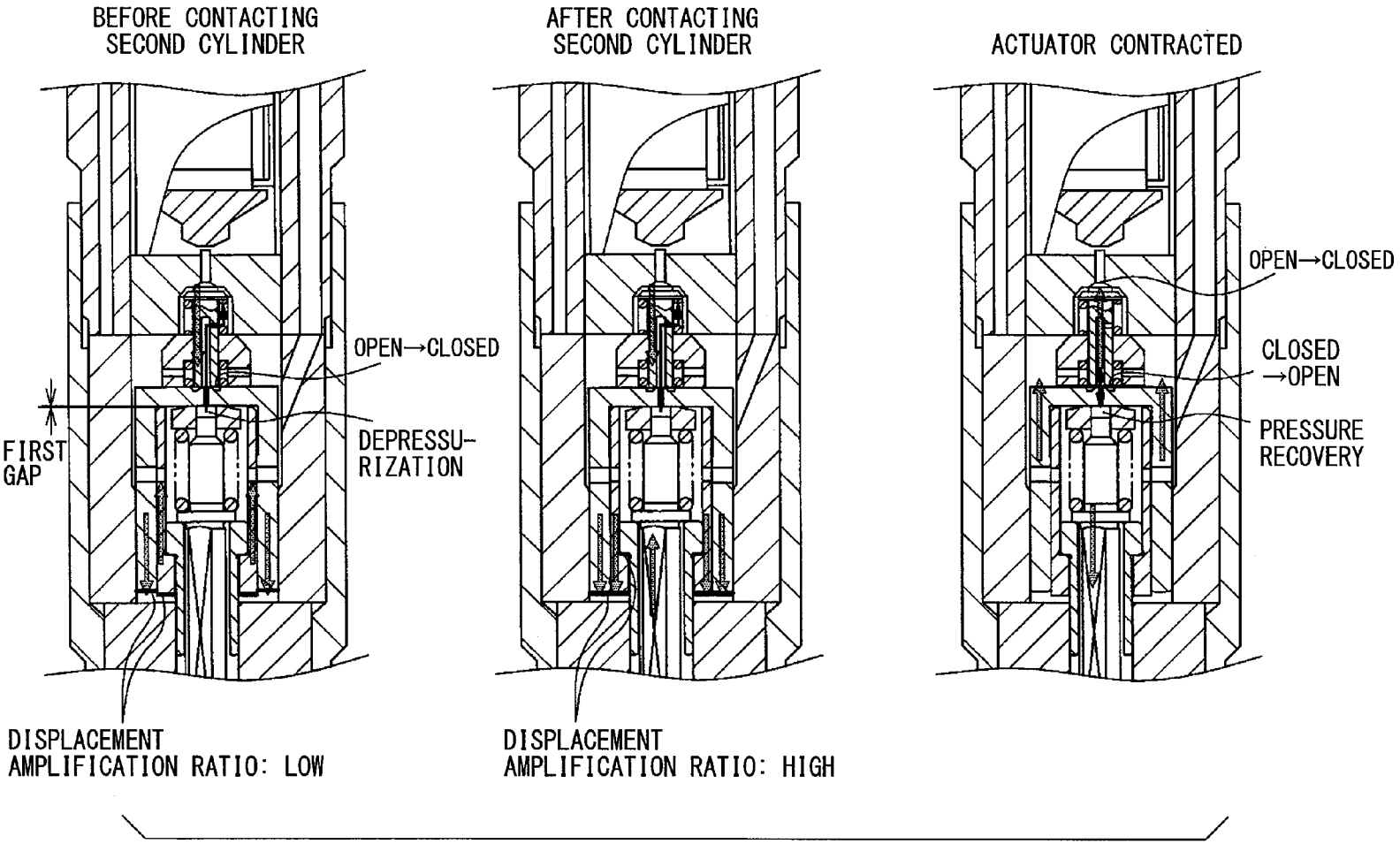
FIG. 12 is a view showing an operation of a fuel injection valve according to the modified example of FIG. 11.

However, when the first gap 62 is closed, as shown in the middle of FIG. 12, the second cylinder 60 is pressed toward the actuator 2 by the large-diameter piston 12. Accordingly, the protrusion portion 60*a* of the second cylinder 60 separates from the protrusion portion 64*a* of the abutment member 64. Then, together with the large-diameter piston 12, the protrusion portion 60*a* of the second cylinder 60 presses against the fuel in the oil-tight chamber 61, and the driving force of the actuator 2 is transmitted through the fuel in the oil-tight chamber 61 to the needle 17.

When the actuator 2 contracts, as shown on the right of FIG. 12, the pressing force from the actuator 2 on the control valve element 6 is gone, and so due to the valve spring 7, the control valve element 6 is biased toward the actuator 2. Accordingly, the pressing force from the control valve element 6 on the large-diameter piston 12 is also gone, and so due to the nozzle spring 14 housed in the pressing chamber 34, the large-diameter piston 12 is biased through the needle cylinder 13 toward the actuator 2. Further, since the control valve element 6 separates from the large-diameter piston 12, the high pressure chamber 30 becomes connected with the control chamber 11, and fuel from the high pressure chamber 30 flows into the control chamber 11, thereby increasing the pressure in the control chamber 11.

Due to this, the needle 17 moves toward the injection hole 19, and the pressing portion 35 presses the abutment member 64 toward the injection hole 19. As a result, the protrusion portion 64*a* of the abutment member 64 abuts the protrusion portion 60*a* of the second cylinder 60. Then, since the abutment member 64 presses the second cylinder 60 toward the injection hole 19, the second cylinder 60 also moves toward the injection hole 19. Due to this, the first gap 62 is formed between an end portion of the second cylinder 60 toward the actuator 2 and the surface of the large-diameter piston 12 that faces this end portion.

When configured in this manner, it is possible to change from a state in which the large-diameter piston 12 alone causes the needle 17 to move in a direction that causes fuel to be injected from the injection hole 19, to a state in which the driving force of the actuator 2 is increased and transmitted to the needle 17.

Figure 13:
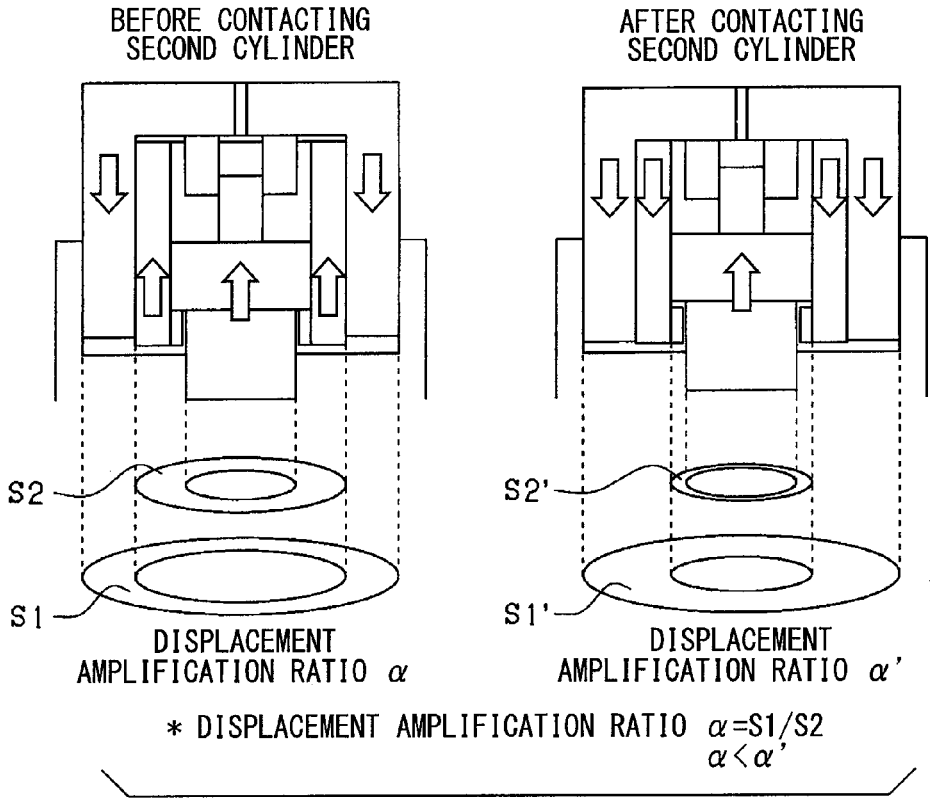
FIG. 13 is a view showing a relationship between areas of components contacting an oil-tight chamber according to the modified example of FIG. 11.

Regarding the present modified example, a displacement amplification ratio $\alpha$ of when only the large-diameter piston 12 is pressing on the fuel in the oil-tight chamber 61 is configured to be smaller than a displacement amplification ratio $\alpha'$ of when both the second cylinder 60 and the large-diameter piston 12 are pressing on the fuel in the oil-tight chamber 61. In this case, additional effects may be exhibited. Specifically, as shown in FIG. 13, the portion of the large-diameter piston 12 that presses on the fuel in the oil-tight chamber 61 has an area of S1. Further, the portions of the second cylinder 60 and the needle 17 pressed by the fuel in the oil-tight chamber 61 has a total area of S2.

Here, the displacement amplification ratio $\alpha$ corresponds to a quotient of dividing the area S1 by the area S2. In addition, the portions of the large-diameter piston 12 and the cylinder that press on the fuel in the oil-tight chamber 61 has a total area of S1'. Further, the portion of the needle 17 pressed by the fuel in the oil-tight chamber 61 has an area of S2'. Here, the displacement amplification ratio α' corresponds to a quotient of dividing the area S1' by the area S2. The displacement amplification ratio α calculated as described above is configured to be smaller than the displacement amplification ratio α'.

According to the above described configuration, it is possible to reduce the movement amount of the needle 17 toward the actuator 2 when only the large-diameter piston 12 is pressing on the fuel in the oil-tight chamber 61. Conversely, it is possible to increase the movement amount of the needle 17 toward the actuator 2 when both the second cylinder 60 and the large-diameter piston 12 are pressing on the fuel in the oil-tight chamber 61. In addition, it is possible to increase the driving force to the needle 17 when only the large-diameter piston 12 is pressing on the fuel in the oil-tight chamber 61.

Conversely, it is possible to decrease the driving force to the needle 17 when both the second cylinder 60 and the large-diameter piston 12 are pressing on the fuel in the oil-tight chamber 61.

According to the above described embodiment, as shown in FIG. 2, the oil-tight chamber 16 is defined by the portion of the needle 17 around the lower end of the pressing portion 35, the lower portion of the large-diameter piston 12, and the portion of the nozzle body 15 which protrudes into the lower body 10. In this case, when the needle 17 moves toward the actuator 2 due to the fuel pressure in the control chamber 11 decreasing or the like, the volume in the oil-tight chamber 16 increases and the fuel pressure in the oil-tight chamber 16 decreases (refer to the left of FIG. 14).

As the fuel pressure in the oil-tight chamber 16 decreases, the large-diameter piston 12 may move in a direction that suppresses the fuel pressure in the oil-tight chamber 16 from decreasing, and therefore there is a concern that the control valve element 6 may fail to block the connection between the high pressure chamber 30 and the control chamber 11. In this case, the fuel pressure in the control chamber 11 would increase, and suppress the needle 17 from moving in a direction that causes fuel to be injected from the injection hole 19.

Figure 14:
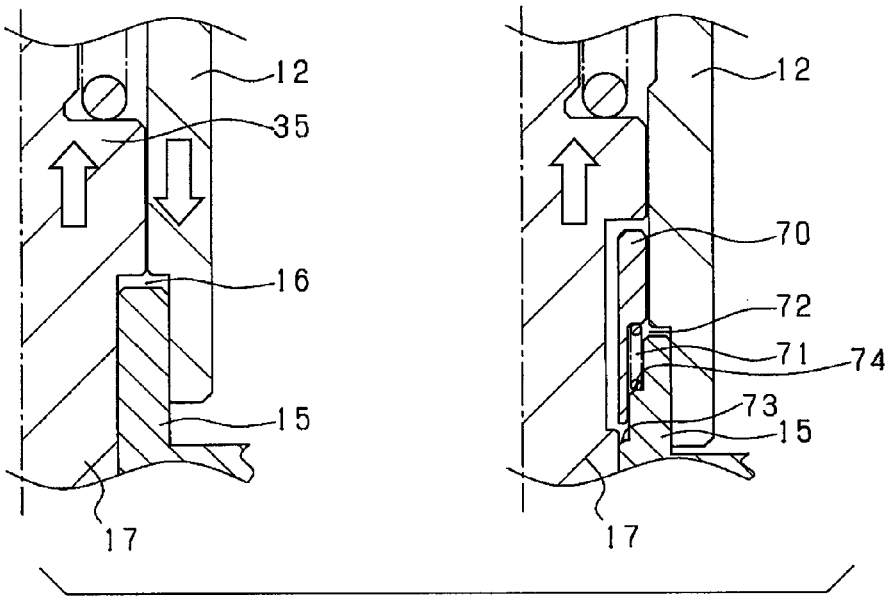
FIG. 14 is a cross sectional view of a fuel injection valve according to a modified example.

As a countermeasure to this, as shown on the right of FIG. 14, a third cylinder 70 that moves in the axial direction may be provided. The lower portion of the third cylinder 70 is supported by the inner circumferential surface of the nozzle body 15 in an airtight manner, and the upper portion of the third cylinder 70 is supported by the inner circumferential surface of the large-diameter piston 12 in an airtight manner. Specifically, the portion of the nozzle body 15 that protrudes into the lower body 10 (hereinafter referred to as a protrusion portion) includes two stepped portions at a side surface that faces the needle 17. The stepped portions are indented in a stepped shape in a direction orthogonal to the axial direction. Of these, the stepped portion toward the needle 17 and the injection hole 19 is referred to as a first stepped portion 73, while the stepped portion toward the protrusion portion upper end of the nozzle body 15 is referred to as a second stepped portion 74.

The lower end portion of the third cylinder 70 is abuttable with the first stepped portion. An oil-tight chamber 72 is formed by the large-diameter piston 12, the third cylinder 70, and the nozzle body 15. a third cylinder spring 71 is housed in the oil-tight chamber 72. The upper end portion of the third cylinder spring 71 abuts the upper portion of the third cylinder 70, and the lower end portion of the third cylinder spring 71 abuts the second stepped portion 74. The third cylinder spring 71 biases the third cylinder 70 toward the actuator 2.

The operation of the fuel injection valve of the present modified example will be explained. When the actuator 2 is in a contracted state, the fuel pressure in the control chamber 11 is high, and thus the needle 17 moves toward the injection hole 19 and blocks fuel from flowing toward the injection hole 19. In this case, the needle 17 is pressing against the third cylinder 70, and since the pressing force of the third cylinder 70 on the oil-tight chamber 72 is transmitted to the large-diameter piston 12, the large diameter piston 12 moves toward the actuator 2.

When the actuator 2 extends, the large-diameter piston 12 is pressed by the control valve element 6. The pressing force of the large-diameter piston 12 on the oil-tight chamber 72 is transmitted through the third cylinder 70 to the needle 17 which abuts the upper end surface of the third cylinder 70. As a result, the needle 17 moves toward the actuator 2.

According to such a configuration, even if the needle 17 moves in a direction that causes fuel to be injected from the injection hole 19 due to, for example, the control chamber 11 depressurizing, the oil-tight chamber 72 is isolated from the needle 17, and therefore the fuel pressure in the oil-tight chamber 72 is not affected. Accordingly, the fuel pressure in the oil-tight chamber 72 only changes based on the movement of the large-diameter piston 12, and the movement of the needle 17 may be stabilized.

Figure 15:
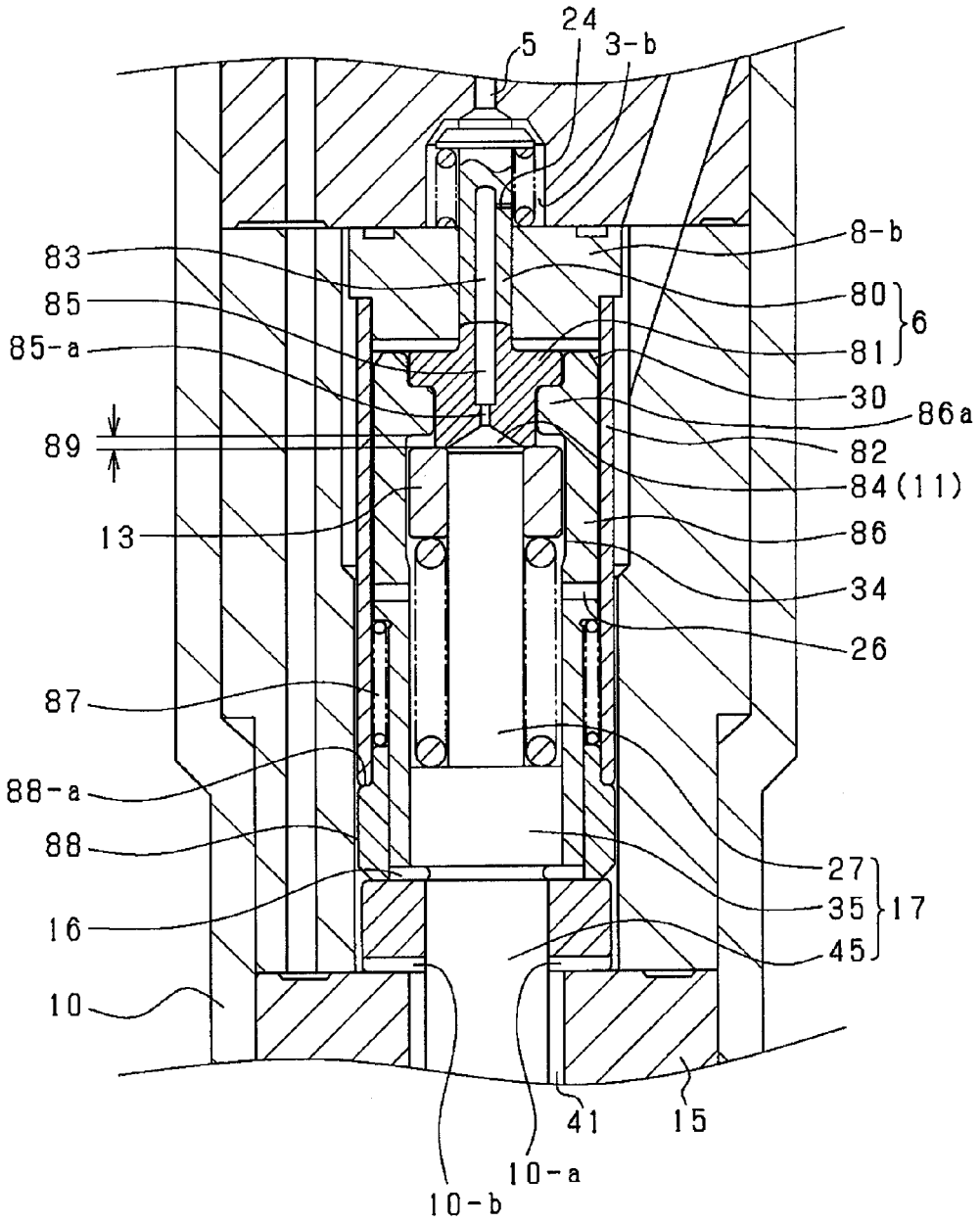
FIG. 15 is a cross sectional view of a fuel injection valve according to a modified example.

In the above described embodiment, as shown in FIG. 2, the control valve element 6 is slidably supported by the second valve body 8-*b* and the valve cylinder 9. Alternatively, the valve cylinder 9 may be not provided, and as shown in FIG. 15 for example, the control valve element 6 may be split into two parts.

Specifically, the control valve element 6 includes a second chamber connection member 80 and a first chamber connection member 81. The second chamber connection member 80 is slidably supported by the second valve body 8-*b*. The upper end portion of the second chamber connection member 80 is connected to the lower end portion of the drive transmission pin 5, and the lower end portion of the second chamber connection member 80 is formed to be abuttable with the upper end portion of the first chamber connection member 81.

In addition, a large-diameter piston 86 is configured such that the upper portion of the large-diameter piston 86 surrounds the first chamber connection member 81. Further, a first piston spring 82 is disposed surrounding the large-diameter piston 86. The first piston spring 82 biases to separate the second valve body 8-*b* from a fixed member 88.

The upper end portion of the first piston spring 82 is attached to the second valve body 8-*b*, and the lower end portion of the first piston spring 82 is attached to a stepped portion 88-*a* of the fixed member 88. The lower end portion of the fixed member 88 abuts a second lower body 10-*a* which is described later. Further, the stepped portion 88-*a*, which is intended in a stepped manner, is formed on the outer circumferential surface of the fixed member 88.

The second lower body 10-*a* is housed within the lower body 10. In addition, the second lower body 10-*a* abuts the upper end portion of the nozzle body 15, and slidably supports the upper portion of the circular column portion 45. The outer circumferential surface of the second lower body 10-*a* is separated from the inner circumferential surface of the lower body 10. Further, the lower portion of the second lower body 10-*a* has a high pressure fuel communication passage 10-*b* formed therein. Accordingly, the fuel in the high pressure chamber 30 flows through the high pressure fuel communication passage 10-*b* toward the first high pressure passage 41.

The outer diameter of the lower portion of the large-diameter piston 86 is formed to be smaller than the outer diameter of the upper portion of the same. Further, the lower portion of the large-diameter piston 86 is slidably supported by the fixed member 88.

A second piston spring 87 is disposed in a space formed between the first piston spring 82, the lower portion of the large-diameter piston 86, and the upper end portion of the fixed member 88. The second piston spring 87 biases the large-diameter piston 86 toward the actuator 2, and causes the first chamber connection member 81 to abut with an annular protrusion portion 86*a* formed on the inner circumferential surface of the large-diameter piston 86. Accordingly, when the actuator 2 is in a contracted state, a second gap 89 exists between the upper end portion of the needle cylinder 13 and the lower end portion of the protrusion portion 86*a* of the large-diameter piston 86.

The pressing chamber 34 is formed in the large-diameter piston 86. The configuration in the pressing chamber 34 is the same as the configuration of the above described embodiment. Further, in the same manner as the configuration of the above described embodiment, the first communication passage 26 is disposed in the large-diameter piston 86 such that the high pressure fuel from the high pressure chamber 30 flows in.

The oil-tight chamber 16 is formed by the lower end portion of the large-diameter piston 86, the portion of the needle 17 around the lower end of the pressing portion 35, the fixed member 88, and the upper end portion of the second lower body 10-*a*.

The bottom end portion of the first chamber connection member 81 is configured such that a portion thereof is separated from the upper surface of the needle cylinder 13, while another portion thereof abuts the needle cylinder 13. In the present modified example, a conical cavity portion 84 is formed so as to have an apex at substantially the center of the first chamber connection member 81, with the lower end portion of the first chamber connection member 81 which abuts the needle cylinder 13 as a base. For this reason, when the lower end portion of the first chamber connection member 81 abuts the needle cylinder 13, the control chamber 11 includes the cavity portion 84, and the capacity of the control chamber 11 is increased.

A first middle chamber 85, which is a flow path in which fuel flows, is disposed inside the first chamber connection member 81. The lower portion of the first middle chamber 85 opens at the apex of the cavity portion 84 through a third common orifice 85-*a*. Further, the upper portion of the first middle chamber 85 opens at the upper end portion of the first chamber connection member 81. When the lower end portion of the second chamber connection member 80 is separated from the upper end portion of the first chamber connection member 81, the high pressure chamber 30 and the cavity portion 84 are connected to each other through the first middle chamber 85 and the third common orifice 85-*a*.

A second middle chamber 83, which is a flow path in which fuel flows, is disposed inside the second chamber connection member 80. The lower portion of the second middle chamber 83 opens at the lower end portion of the second chamber connection member 80. The upper portion of the second chamber connection member 80 is connected to the valve chamber 3-*b* through the outer orifice 24. Accordingly, when the lower end portion of the second chamber connection member 80 is separated from the upper end portion of the first chamber connection member 81, the high pressure chamber 30 and the valve chamber 3-*b* are connected to each other through the second middle chamber 83 and the outer orifice 24.

When the lower end portion of the second chamber connection member 80 abuts the upper end portion of the first chamber connection member 81, both the connection between the high pressure chamber 30 and the cavity portion 84 through the first middle chamber 85 and the third common orifice 85-*a*, as well as the connection between the high pressure chamber 30 and the valve chamber 3-*b* through the second middle chamber 83, are blocked. Conversely, the cavity portion 84 and the valve chamber 3-*b* are connected to each other through the outer orifice 24, the second middle chamber 83, the first middle chamber 85, and the third common orifice 85-*a*.

According to the configuration of the present modified example, when the control chamber 11 depressurizes and the needle 17 moves in a direction that causes fuel to be injected from the injection hole 19, the pressure of the fuel in the oil-tight chamber 16 decreases. As the pressure of the fuel in the oil-tight chamber 16 decreases, there is a concern that the first chamber connection member 81 will move toward the injection hole 19, thereby causing the second chamber connection member 80 to separate from the first chamber connection member 81, and connecting the control chamber 11 with the high pressure chamber 30.

If the control chamber 11 is connected with the high pressure chamber 30, the pressure of the fuel in the control chamber 11 will rise, thereby suppressing the needle 17 from moving in a direction that causes fuel to be injected from the injection hole 19. Here, the second piston spring 87 causes the large-diameter piston 86 and the first chamber connection member 81 to abut each other. For this reason, if the pressure of the fuel in the oil-tight chamber 16 decreases, the large-diameter piston 86 moves toward the injection hole 19, and thus is able to suppress the pressure of the fuel in the oil-tight chamber 16 from decreasing.

However, if the large-diameter piston 86 moves in a direction that suppresses the fuel pressure in the oil-tight chamber 16 from decreasing, there is a concern that the large-diameter piston 86 may press on the needle cylinder 13 at that time. As a countermeasure to this, the second gap 89 exists between the upper end portion of the needle cylinder 13 and the lower end portion of the protrusion portion 86*a* of the large-diameter piston 86.

Due to being configured in this manner, even if, for example, the large-diameter piston 86 moves in a direction that suppresses the fuel pressure in the oil-tight chamber 16 from decreasing, the needle cylinder 13 will not be pressed against by the large-diameter piston 86 until the second gap 89 is closed. Further, since the first chamber connection member 81 is independent of the large-diameter piston 86, the first chamber connection member 81 does not move according to the movement of the large-diameter piston 86. Accordingly, the large-diameter piston 86 is able to suppress the oil-tight chamber 16 from depressurizing, without affecting the first chamber connection member 81 or the needle cylinder 13.

Regarding the present modified example, the second gap 89 may be set so as to be greater than a maximum movement amount of the large-diameter piston 86, which is calculated by dividing a maximum movement amount of the needle 17 in a direction that causes fuel to be injected from the injection hole 19 by the displacement amplification ratio.

Specifically, the area of the portion of the large-diameter piston 86 that presses on the fuel in the oil-tight chamber 16 is divided by the area of the portion of the needle 17 pressed by the fuel in the oil-tight chamber 16 in a direction that causes fuel to be injected from the injection hole 19. The quotient from this calculation corresponds to the displacement amplification ratio of how much the needle 17 is moved in a direction that causes fuel to be injected from the injection hole 19 with respect to the movement amount of the large-diameter piston 86. Accordingly, the movement amount of the needle 17 in a direction that causes fuel to be injected from the injection hole 19 may be calculated from the product of the movement amount of the large-diameter piston 86 and the displacement amplification ratio. Due to this, it is understood that the movement amount of the large-diameter piston 86 may be calculated by dividing the movement amount of the needle 17 in a direction that causes fuel to be injected from the injection hole 19 by the displacement amplification ratio.

Meanwhile, when the movement amount of the needle 17 in a direction that causes fuel to be injected from the injection hole 19 is at its maximum value, the movement amount of the large-diameter piston 86 toward the injection hole 19 is at its maximum value. Based on the above, the width of the second gap 89 may be set to be greater than the maximum movement amount of the large-diameter piston 86, which is calculated by dividing the maximum movement amount of the needle 17 in a direction that causes fuel to be injected from the injection hole 19 by the displacement amplification ratio. Due to this, it is possible to reduce the likelihood of the large-diameter piston 86 contacting the needle cylinder 13 even when the large-diameter piston 86 has moved the maximum amount toward the needle cylinder 13.

Figure 16:
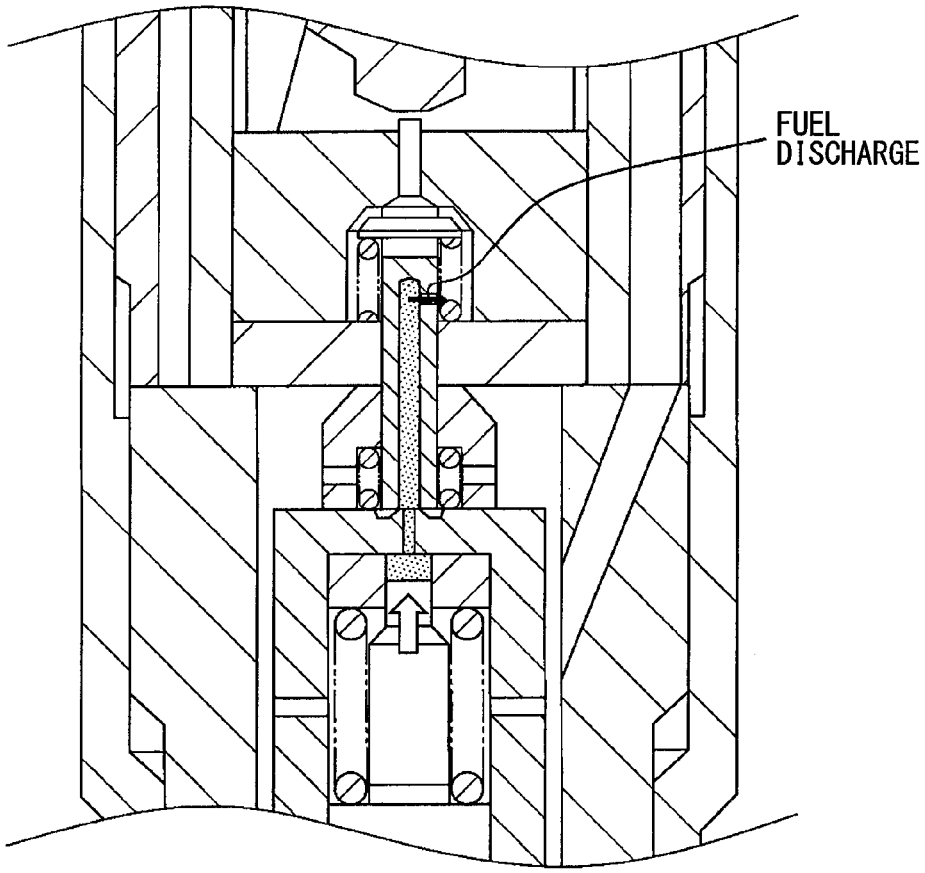
FIG. 16 is a view showing an outflow path of fuel in a control chamber according to a present embodiment.

According to the above described embodiment, as shown in FIG. 16, from the upper end portion of the control chamber 11 to the upper end portion of the small-diameter piston portion 27, the area is formed to be constant. In this case, when the actuator 2 extends, the high pressure chamber 30 is blocked from the control chamber 11, and the control valve element 6 connects the low pressure chamber 4-*b*, the valve chamber 3-*b*, and the control chamber 11 with each other, so that the fuel in the control chamber 11 flows through the valve chamber 3-*b* and into the low pressure chamber 4-*b*. However, when the actuator 2 extends, the fuel from the control chamber 11 may also flow out from a path other than the path through the middle chamber 23 and the outer orifice 24. A plurality of examples of this are provided below.

Figure 17:
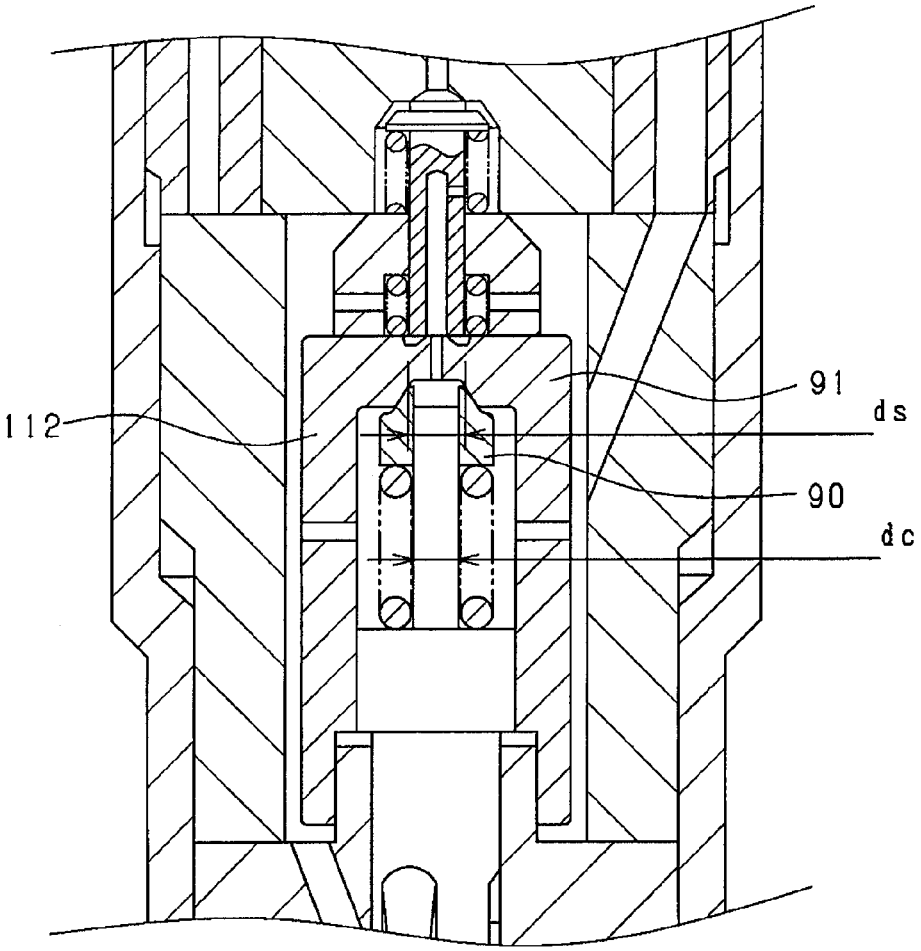
FIG. 17 is a cross sectional view of a fuel injection valve according to a modified example.

(1) As shown in FIG. 17, the upper end portion of a needle cylinder 90 may be configured to be exposed in a control chamber 91. At this time, a portion that does not abut a large-diameter piston 112 is formed on the upper end surface of the needle cylinder 90 in the control chamber 91. Due to being configured in this manner, a diameter ds (area) of the upper end surface of the control chamber 91 is set to be greater than a diameter dc (area) of the lower end surface of the control chamber 91. Accordingly, when the fuel pressure in the control chamber 91 increases, the fuel pressure in the control chamber 91 generates a force that causes the needle cylinder 90 to move toward the injection hole 19.

Figure 18:
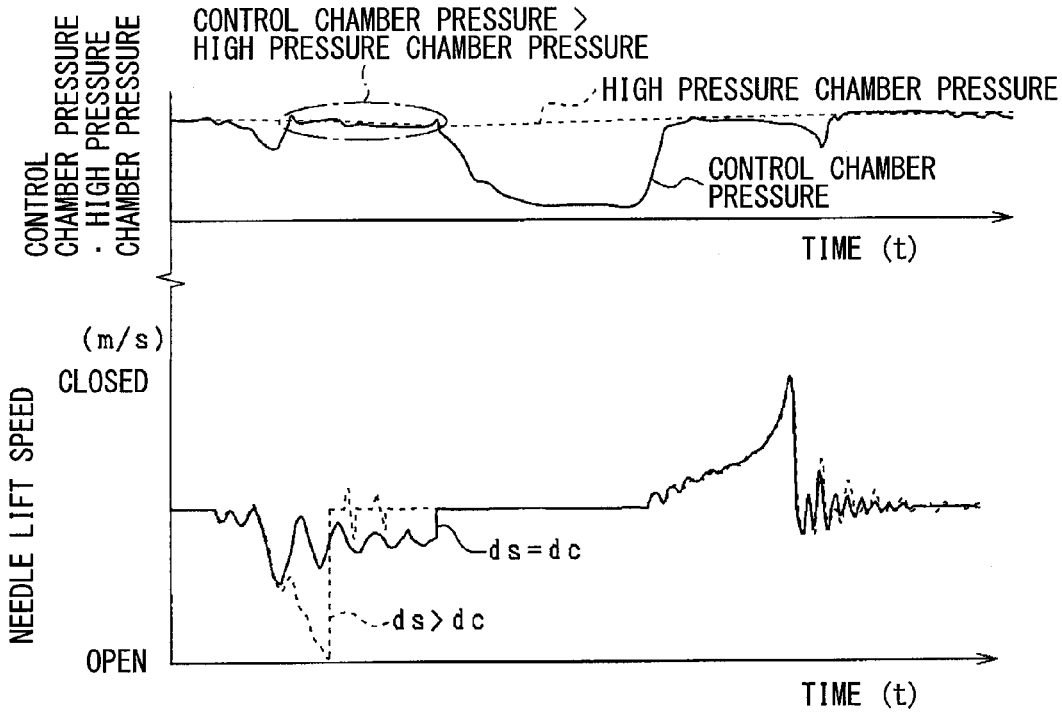
FIG. 18 is a view showing effects exhibited by the modified example of FIG. 17.
Figure 19:
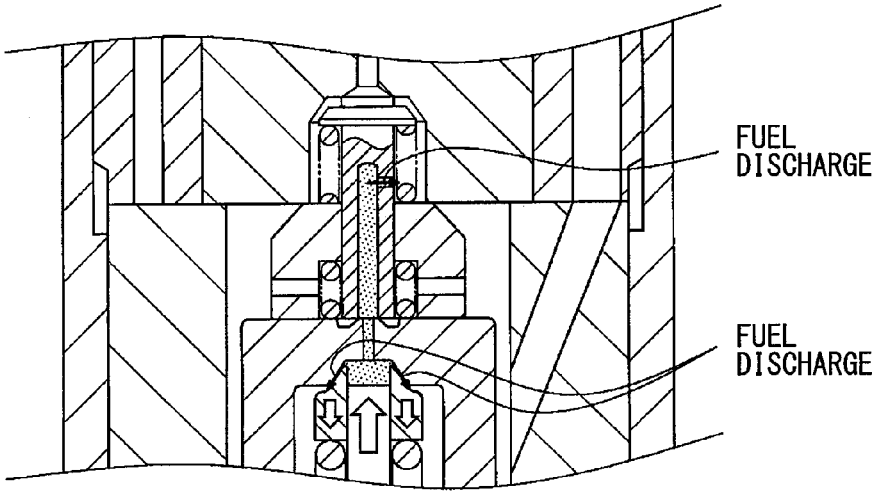
FIG. 19 is a view showing an outflow path of fuel in a control chamber according to the modified example of FIG. 17.

According to such a configuration, when the actuator 2 extends so that the control valve element 6 connects the low pressure chamber 4-*b*, the valve chamber 3-*b*, and the control chamber 91 to each other while blocking the high pressure chamber 30 from the control chamber 91, the control chamber 91 is compressed by the needle 17 or the control valve element 6, and the fuel pressure in the control chamber 91 increases. As shown by the top of FIG. 18, this increased fuel pressure exceeds the pressure of the fuel in the high pressure chamber 30 for a period, and as shown in FIG. 19, the upper end portion of the needle cylinder 90, which is exposed in the control chamber 91, is pressed toward the injection hole 19. Due to this, the needle cylinder 90 moves toward the injection hole 19, and the fuel in the control chamber 91 may leak out from there. Accordingly, the pressure of the fuel in the control chamber 91 may decrease faster. Therefore, as shown by the bottom of FIG. 18, the movement speed of the needle 17 toward the actuator 2 may be faster as compared to the above described embodiment.

Figure 20:
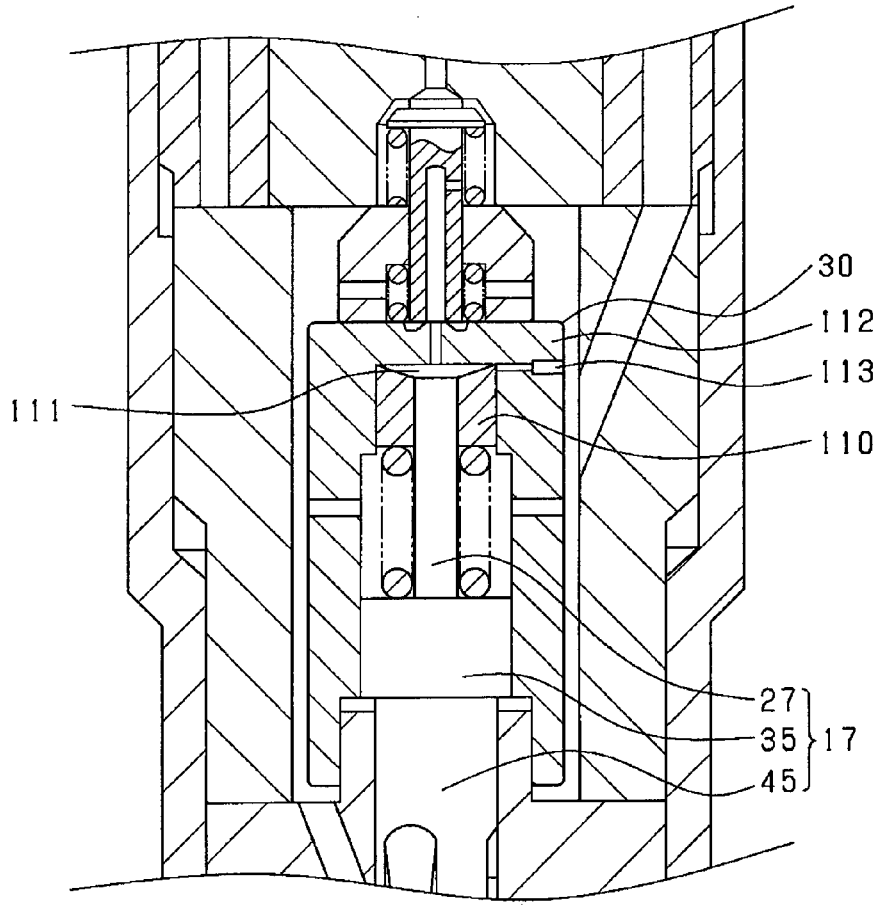
FIG. 20 is a cross sectional view of a fuel injection valve according to a modified example.

(2) As shown in the configuration of FIG. 20 as well, the upper end portion of a needle cylinder 110 is exposed in a control chamber 111. However, the upper end surface of the needle cylinder 110 is formed such that an outer edge thereof abuts a large-diameter piston 112, but an inner edge thereof does not abut the large-diameter piston 112. In other words, the upper end surface of the needle cylinder 110 is sloped from a radially outward side to a radially inward side. In addition, a second outer orifice 113 that connects to the high pressure chamber 30 is formed in the large-diameter piston 112. The second outer orifice 113 is blocked from the control chamber 111 when the upper end portion of the needle cylinder 110 abuts the large diameter piston 112. Conversely, the control chamber 111 is connected to the high pressure chamber 30 through the second outer orifice 113 when the upper end portion of the needle cylinder 110 separates from the large diameter piston 112.

Figure 21:
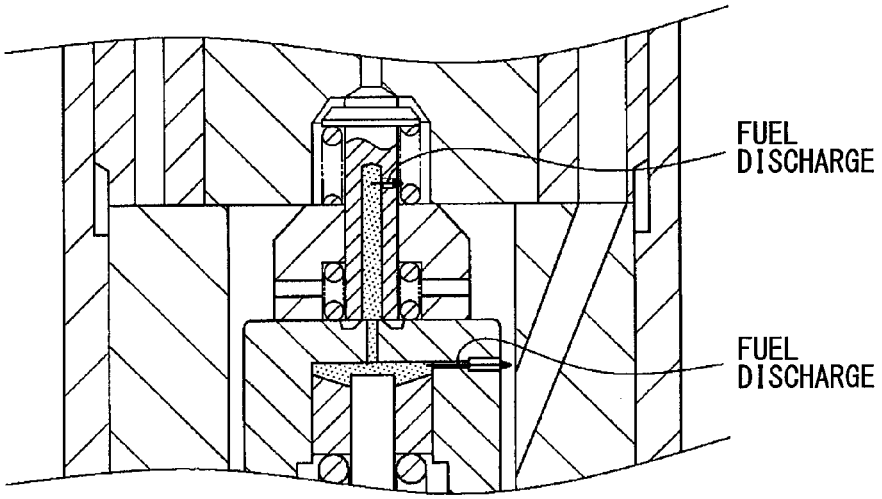
FIG. 21 is a view showing an outflow path of fuel in a control chamber according to the modified example of FIG. 20.

When the fuel pressure in the control chamber 111 exceeds the fuel pressure of the high pressure chamber 30, the end surface of the needle cylinder 110 which is exposed in the control chamber 111 and which faces the actuator 2 is pressed toward the injection hole 19. Accordingly, the needle cylinder 110 moves toward the injection hole 19, and the upper end surface of the needle cylinder 110 separates from the large-diameter piston 112. At this time, the control chamber 111 and the high pressure chamber 30 are connected through the second outer orifice 113. In this case, as shown in FIG. 21, fuel in the control chamber 111 is able to flow out through the middle chamber 23 and the outer orifice 24 formed in the control valve element 6, and is also able to flow out through the second outer orifice 113.

Then, when the fuel in the control chamber 111 is depressurized, the needle cylinder 110 moves back toward the actuator 2. Due to this, the upper end surface of the needle cylinder 110 abuts the large-diameter piston 112, and the control chamber 111 is blocked from the second outer orifice 113 by the needle cylinder 110. Accordingly, the possibility of fuel from the high pressure chamber 30 flowing through the second outer orifice 113 into the control chamber 111 is low, and the fuel pressure in the control chamber 111 may decrease in a smooth manner.

Figure 22:
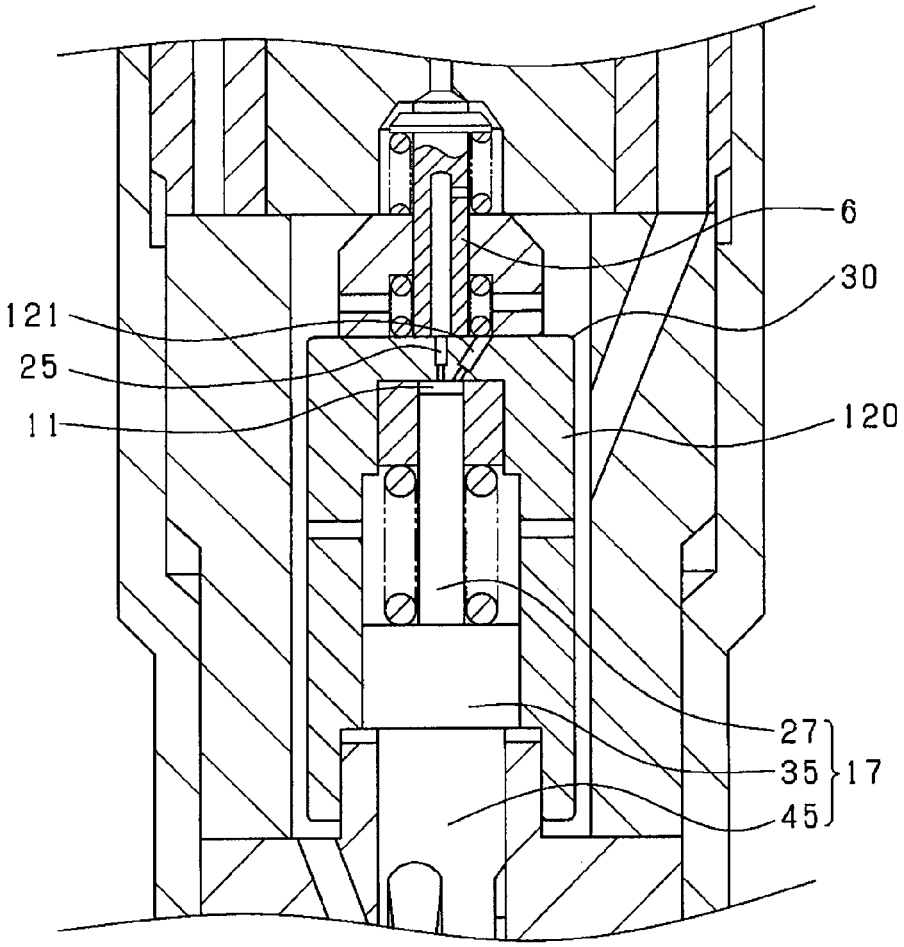
FIG. 22 is a cross sectional view of a fuel injection valve according to a modified example.
Figure 23A:
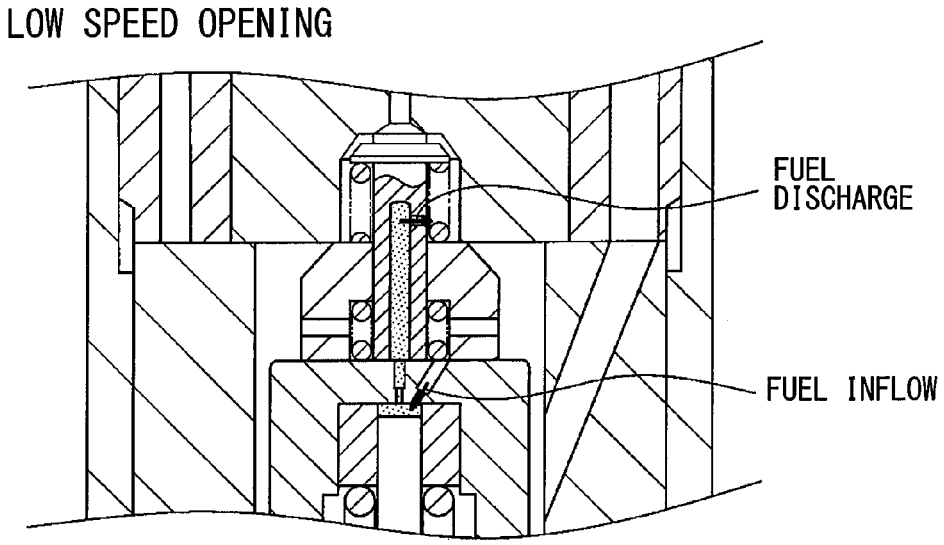
FIGS. 23A and 23B are views showing an outflow path of fuel in a control chamber according to the modified example of FIG. 22.

(3) As shown in FIG. 22, in addition to the common orifice 25, a second common orifice 121 that connects the control chamber 11 with the high pressure chamber 30 is formed in a large-diameter piston 120. When configured in this manner, for example, when the movement speed of the needle 17 in a direction that causes fuel to be injected from the injection hole 19 is set to be slow (low speed valve opening control), the extension amount of the actuator 2 is controlled to be low. Accordingly, the control chamber 11 is not compressed by the needle 17 or the control valve element 6 to the extent that the fuel pressure in the control chamber 11 exceeds the fuel pressure of the high pressure chamber 30. For this reason, as shown in FIG. 23, as the fuel in the control chamber 11 depressurizes, fuel from the high pressure chamber 30 flows through the second common orifice 121 and into the control chamber 11. Accordingly, the depressurization speed of the control chamber 11 may be adjusted to be slower.

Figure 23B:
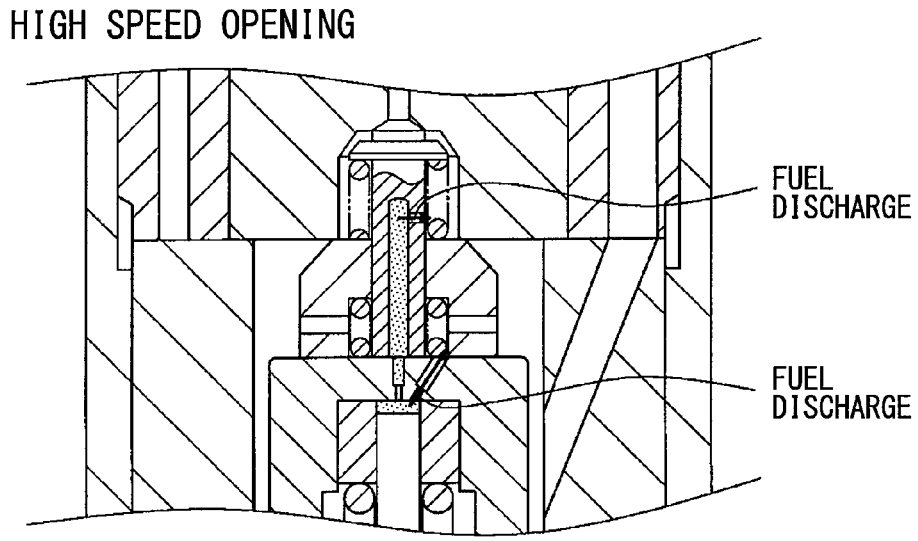

Conversely, when the movement speed of the needle 17 in a direction that causes fuel to be injected from the injection hole 19 is set to be fast (high speed valve opening control), the extension amount of the actuator 2 is controlled to be large. Accordingly, the control chamber 11 is compressed by at least one of the needle 17 and the control valve element 6. Due to this, the fuel pressure in the control chamber 11 increases, and as shown in FIG. 23B, fuel flows from the control chamber 11 through the second common orifice 121 to the high pressure chamber 30. For this reason, the fuel in the control chamber 11 may be depressurized quickly.

Figure 24:
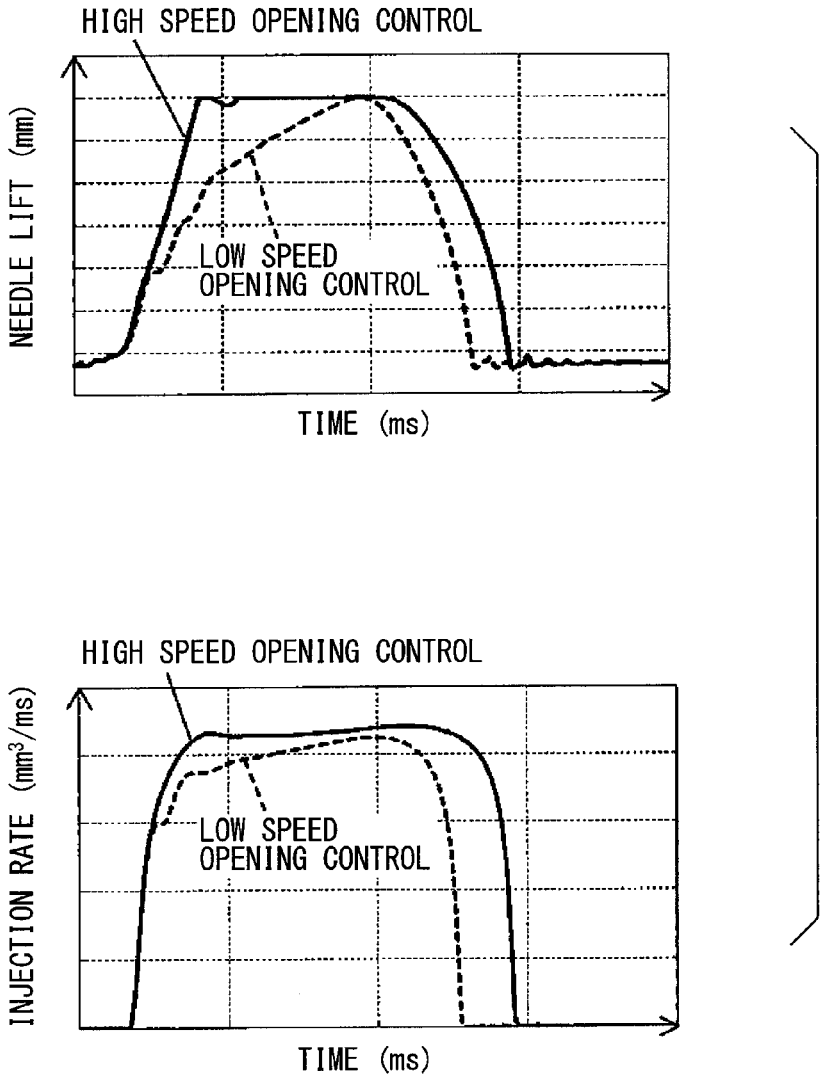
FIG. 24 is a view showing effects exhibited by the modified example of FIG. 22.

The left side of FIG. 24 shows results comparing, according the configuration of the present modified example, the movement amount of the needle 17 toward the actuator 2 (needle lift amount) when performing a low speed valve opening control and when performing a high speed valve opening control. The right side of FIG. 24 compares injection rates for the same. According to the results on the left of FIG. 24, it is understood that the maximum lift amount is reached earlier when performing a high speed valve opening control as compared to performing a low speed valve opening control. Further, since the maximum lift amount is reached earlier when performing a high speed valve opening control, in the right side of FIG. 24 as well, the injection rate during the early stage is also greater than when performing a low speed valve opening control.

Figure 25A:
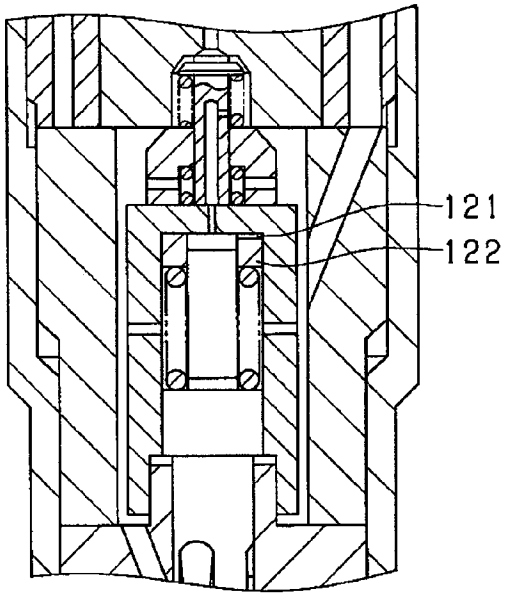
FIGS. 25A, 25B, and 25C are views showing another modification applicable to the modified example of FIG. 22.
Figure 25B:
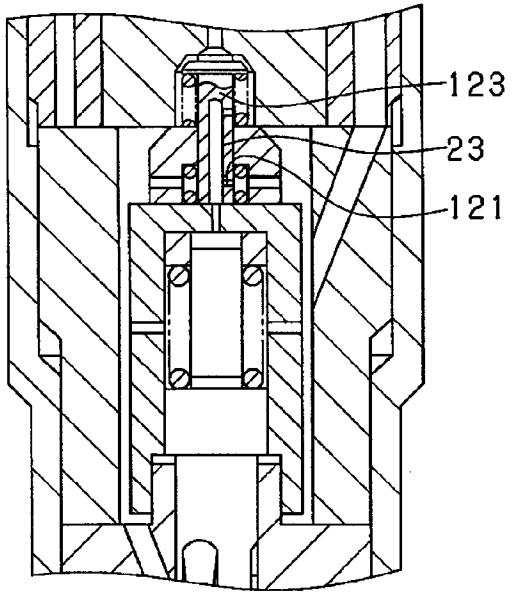
Figure 25C:
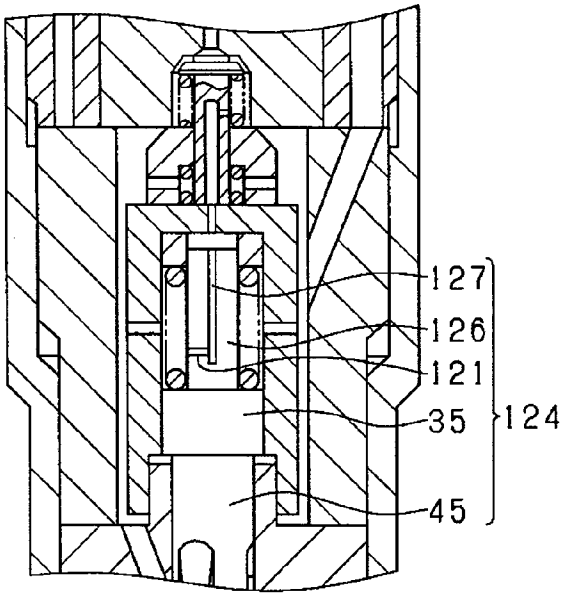

In example (3), the second common orifice 121 is formed in the large-diameter piston 120. However, it is not necessary to form the second common orifice 121 in the large-diameter piston 120. For example, as shown in FIG. 25A, the second common orifice 121 may be formed in the needle cylinder 122 to connect the control chamber 11 with the high pressure chamber 30. Further, as shown in FIG. 25B, the second common orifice 121 may be formed in the control valve element 123 to connect the middle chamber 23 with the high pressure chamber 30. Alternatively, as shown in FIG. 25C, a second middle chamber 127, which is a flow path in which fuel flows, may be disposed in a small-diameter piston portion 126 included in a needle 124. The upper portion of the second middle chamber 127 opens at the upper end portion of the small-diameter piston portion 126, and is in communication with the control chamber 11. Further, the second common orifice 121 is formed in the small-diameter piston portion 126 to connect the second middle chamber 127 with the high pressure chamber 30. According to this configuration as well, the control chamber 11 and the high pressure chamber 30 are connected to each other by the small-diameter piston portion 126 through the second middle chamber 127 and the second common orifice 121.

First Modified Embodiment

Figure 26:
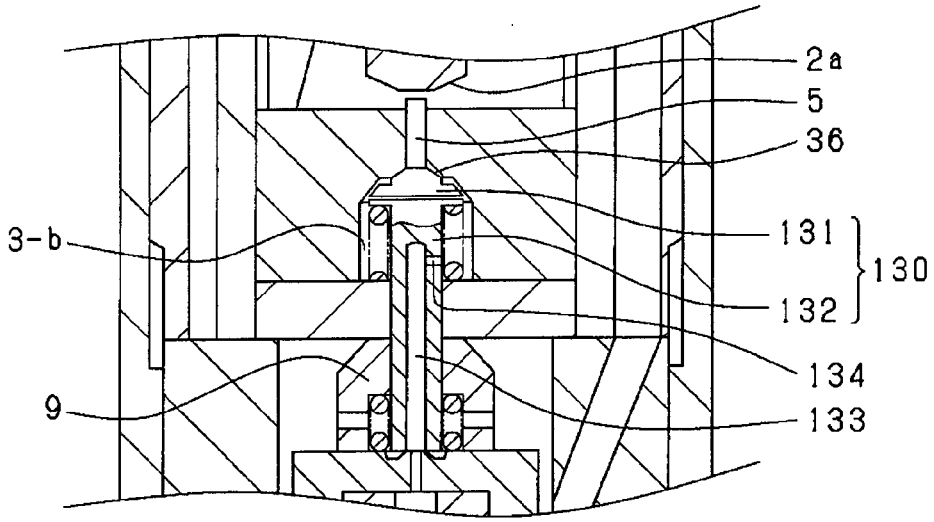
FIG. 26 is a cross sectional view of a fuel injection valve according to a modified example.

In the above described embodiment, as shown in FIG. 2, the upper end portion of the control valve element 6 controls the connection relationship between the low pressure chamber 4-*b* and the valve chamber 3-*b*, while the lower end portion of the control valve element 6 controls the connection relationship between the valve chamber 3-*b*, the control chamber 11, and the high pressure chamber 30. According to such a configuration, if the control valve element 6 is tilted or axially displaced, there is a concern that, for example, the low pressure chamber 4-*b* may not be properly blocked from the valve chamber 3-*b* when the actuator 2 is contracted, or the high pressure chamber 30 may not be properly blocked from the control chamber 11 when the actuator 2 is extended. As a countermeasure to this, as shown in FIG. 26, a control valve element 130 may include a seating portion 131 and a sliding portion 132. In this case, the lower end surface of the seating portion 131 is configured to abut with the upper end surface of the sliding portion 132.

The upper end portion of the seating portion 131 abuts with the lower end portion of the drive transmission pin 5. When the actuator 2 is in a contracted state, the upper end portion of the seating portion 131 seats on the seat portion 36 of the valve chamber 3-*b*.

A third middle chamber 133, which is a flow path in which fuel flows, is disposed in the sliding portion 132. The lower portion of the third middle chamber 133 opens at the lower end portion of the sliding portion 132, and is in communication with the inside of the valve cylinder 9. Further, a third outer orifice 134 is formed in the sliding portion 132. The third outer orifice 134 connects the upper portion of the third middle chamber 133 with the valve chamber 3-*b*. In other words, the sliding portion 132 is able to connect the inside of the valve cylinder 9 with the valve chamber 3-*b* through the third middle chamber 133 and the third outer orifice 134.

According to the configuration of the first modified embodiment, while the lower end surface of the seating portion 131 and the upper end surface of the sliding portion 132 are connected and moving in the axial direction, even if one of these elements is axially displaced, the other element is not coupled to this axial displacement, and the effects thereof may be suppressed.

Figure 27:
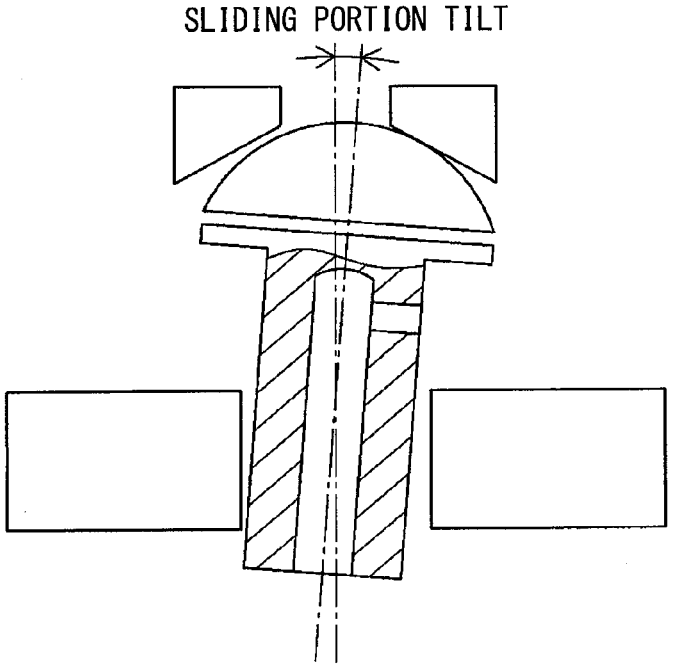
FIG. 27 is a view showing effects and another modification applicable to the modified example of FIG. 26.

Regarding the first modified embodiment, as shown in FIG. 27, the surface of the seating portion 131, which contacts the seat portion 36 of the valve chamber 3-*b* when the actuator 2 is in a contracted state, may be formed as a spherical surface. In this case, even if for example the seating portion 131 tilts, since the surface which contacts the seat portion 36 of the valve chamber 3-*b* is a spherical surface, that tilt may be absorbed. Accordingly, while the actuator 2 is in a contracted state, it is possible to reliably block the low pressure chamber 4-*b* from the valve chamber 3-*b*, and reliably connect the high pressure chamber 30, the valve chamber 3-*b*, and the control chamber 11 to each other.

According to the first modified embodiment, the lower end surface of the seating portion 131 is configured to abut with the upper end surface of the sliding portion 132. Alternatively, the lower end portion of the seating portion 131 and the upper end portion of the sliding portion 132 may be fitted to each other in a convex-concave fashion with a gap. Examples of this are provided below.

Figure 28:
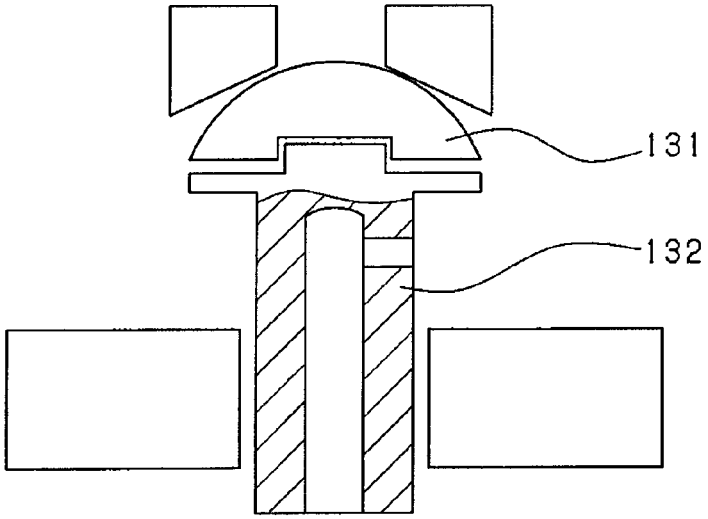
FIG. 28 is a view showing another modification applicable to the modified example of FIG. 26.
Figure 29:
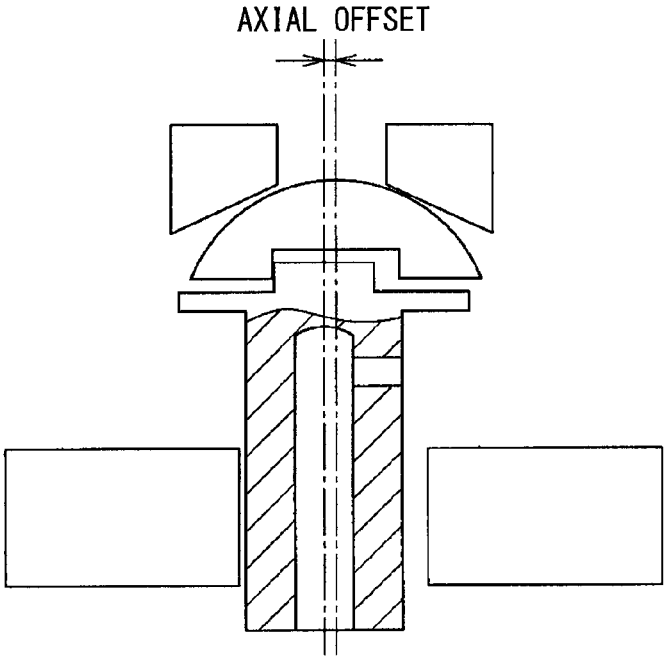
FIG. 29 is a view showing effects exhibited by the modified example of FIG. 28.

(4) As shown in FIG. 28, a recessed portion, which recesses in a stepped manner toward the actuator 2, is disposed in the middle of the lower end portion of the seating portion 131. In addition, a protruding portion, which protrudes toward the seating portion 131, is disposed in the middle of the upper end portion of the sliding portion 132. At this time, the width of the recessed portion formed in the seating portion 131 is formed to be wider than the width of the protruding portion formed in the sliding portion 132. In addition, the lower end portion of the seating portion 131 and the upper end portion of the sliding portion 132 are fitted to each other in a convex-concave fashion with a gap. When configured in this manner, as shown in FIG. 29, it is assumed that the axis of the sliding portion 132 is axially offset with respect to a reference axis along which the actuator 2 extends and along which the needle 17 moves in a direction that opens the injection hole 19. In this case, the axial displacement of the sliding portion 132 may be suppressed from affecting the seating portion 131 over a range in which the protruding portion formed in the sliding portion 132 does not contact the recessed portion formed in the seating portion 131.

Figure 30:
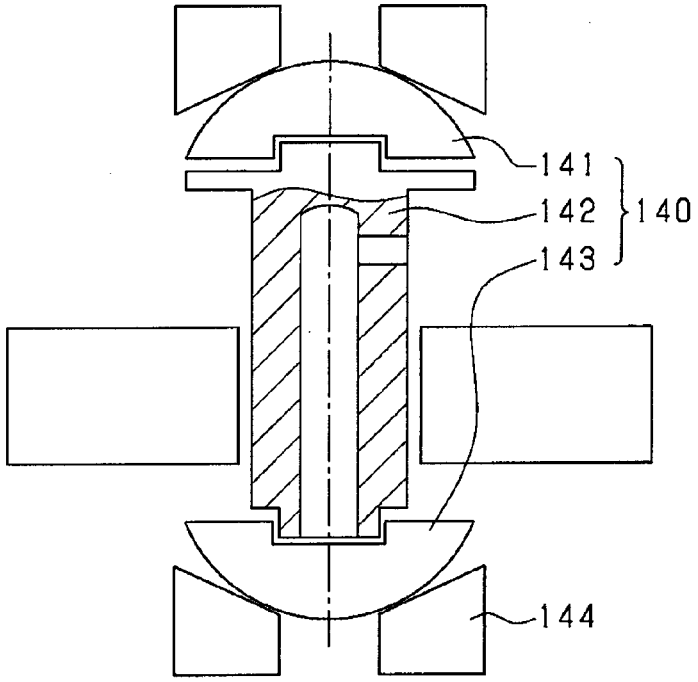
FIG. 30 is a view showing another modification applicable to the modified example of FIG. 28.

The configuration of a modified example based on the configuration of (4) is shown in FIG. 30. In (4), the control valve element 130 includes the seating portion 131 and the sliding portion 132, a recessed portion which recesses in a stepped manner toward the actuator 2 is disposed in the middle of the lower end portion of the seating portion 131, and a protruding portion which protrudes toward the seating portion 131 is disposed in the middle of the upper end portion of the sliding portion 132. In FIG. 30, a control valve element 140 includes a seating portion 141, a sliding portion 142, and a second seating portion 143. According to this configuration, a protruding portion which protrudes toward the injection hole 19 is disposed in the middle of the lower end portion of the sliding portion 142, while a recessed portion which recesses in a stepped manner toward the injection hole 19 is disposed in the middle of the upper end portion of the second seating portion 143.

Here, the width, in a direction orthogonal to the axial direction, of the recessed portion disposed in the middle of the upper end portion of the second seating portion 143 is formed to be wider than the width, in the same direction, of the protruding portion formed in the middle of the lower end portion of the sliding portion 142. In this state, the lower end portion of the sliding portion 142 and the upper end portion of the second seating portion 143 are fitting to each other in a convex-concave manner with a gap. Meanwhile, the upper end portion of the sliding portion 142 and the lower end portion of the seating portion 141 are configured in the same manner as the configuration described in (4). Accordingly, as the actuator 2 extends and contracts, the lower end portion of the sliding portion 142 and the upper end portion of the second seating portion 143, as well as the upper end portion of the sliding portion 142 and the lower end portion of the seating portion 141, move in the axial direction while fitted in a convex-concave manner.

When the actuator 2 extends, the second seating portion 143 abuts the large-diameter piston 12. The surface of the second seating portion 143 that abuts the large-diameter piston 12 is formed as a spherical surface. Then, a seat member 144 is disposed at a predetermined location of the upper end portion of the large-diameter piston 12, the predetermined location being the location assumed to abut with the lower end portion of the second seating portion 143. The seat member 144 corresponds to the shape of the lower end portion of the second seating portion 143. Accordingly, the lower end portion of the second seating portion 143 is in close contact with the top end portion of the large-diameter piston 12. Here, in order to avoid hindering the fuel flow in the common orifice 25 of the large-diameter piston 12, a portion of the seat member 144 is hollowed out such that the opening of the common orifice 25 toward the control valve element 140 is not blocked.

According to the configuration shown in FIG. 30, in addition to the effects described under (4), when the actuator 2 is extended, it is possible to reliably maintain the connection between the low pressure chamber 4-*b*, the valve chamber 3-*b*, and the control chamber 11, and also to reliably maintain the connection between the high pressure chamber 30 and the control chamber 11 in a blocked state.

Figure 31:
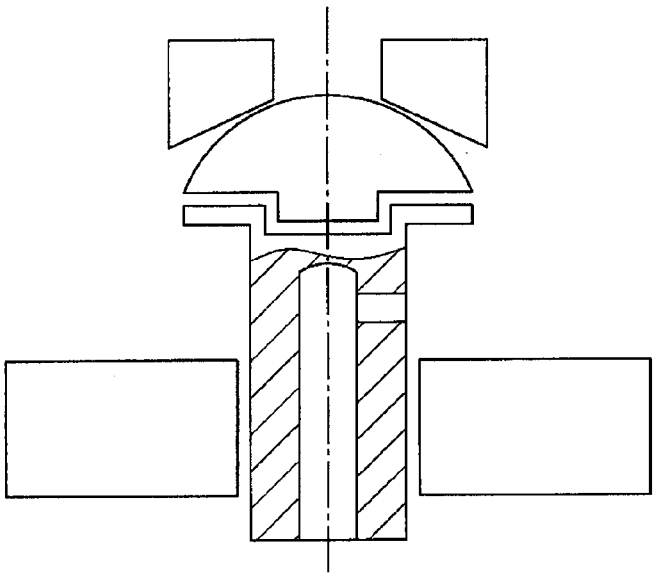
FIG. 31 is a view showing another modification applicable to the modified example of FIG. 28.

(5) As shown in FIG. 31, a protruding portion that protrudes toward the sliding portion 132 may be disposed in the center of the lower end portion of the seating portion 131, and a recessed portion that recesses toward the injection hole 19 may be disposed in the center of the upper end portion of the sliding portion 132. According to this configuration, in a similar manner as example (4), the lower end portion of the seating portion 131 and the upper end portion of the sliding portion 132 may be fitted to each other in a convex-concave fashion with a gap. Accordingly, the same effects as those described for example (4) may be exhibited.

Figure 32:
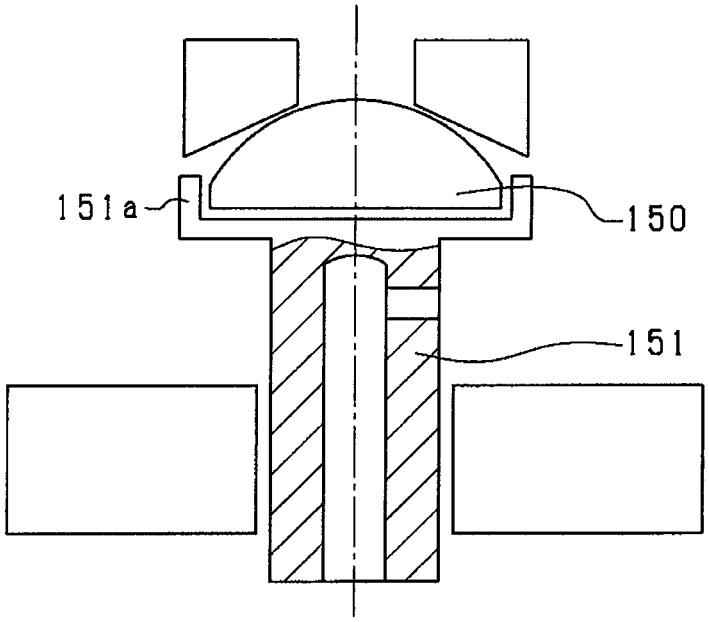
FIG. 32 is a view showing another modification applicable to the modified example of FIG. 26.

As shown in FIG. 32, the are of the upper end portion of a sliding portion 151 may be formed to be wider than the area of the lower end portion of a seating portion 150, and an annular protruding portion 151*a* that protrudes toward the seating portion 150 may be disposed along the outer edge portion of the upper end portion of the sliding portion 151. A gap is provided between the inner circumferential surface of the protruding portion 151*a* and the outer circumferential surface of the seating portion 150. Accordingly, even if the sliding portion 151 is axially displaced, the axial displacement of the sliding portion 151 may be suppressed from affecting the seating portion 150 over a range in which the inner circumferential surface of the protruding portion 151*a* disposed on the upper end portion of the sliding portion 151 does not contact the outer circumferential surface of the seating portion 150.

Figure 33:
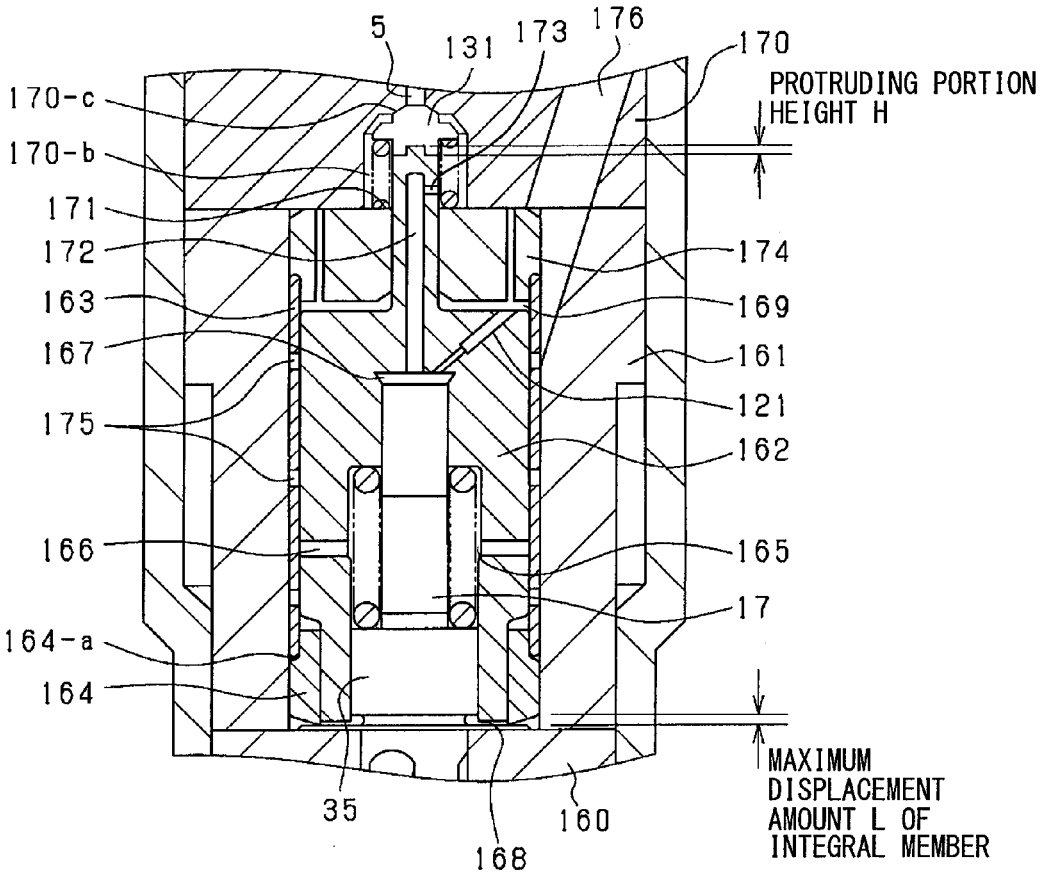
FIG. 33 is a cross sectional view of a fuel injection valve according to a modified example.

According to the first modified embodiment, the control valve element 130 includes the seating portion 131 and the sliding portion 132. Alternatively, as shown in FIG. 33, the sliding portion 132, the large-diameter piston 12, and the needle cylinder 13 may be integrally formed. This integrally formed member is referred to as an integral member 162, and the specific configuration thereof is explained below.

The upper end surface of the nozzle body 160 and the lower end surface of the lower body 161 are locked in a state of abutting one another by a retainer nut or the like. A high pressure chamber 169 is formed in the lower body 161. The high pressure chamber 169 houses a portion of the integral member 162, a fixed member 163, and an oil-tight chamber forming member 164. A second flow path 176 is connected to the high pressure chamber 169. High pressure fuel is stored in the high pressure chamber 169 through the second flow path 176.

A pressing chamber 165 is formed in the integral member 162 housed in the high pressure chamber 169. The pressing chamber 165 houses a portion of the needle 17 (whose configuration is based on the above described embodiment). In addition, a fourth communication passage 166 is disposed in the integral member 162. High pressure fuel from the high pressure chamber 169 flows in through the fourth communication passage 166, which is connected to the pressing chamber 165.

The upper end side in the pressing chamber 165 is referred to as a control chamber 167, and is a space defined by the needle 17 and the integral member 162. In addition, the second common orifice 121 (having the same configuration as the second common orifice 121 described in (3) above), which connects the high pressure chamber 169 with the control chamber 167, is formed in the integral member 162.

The fixed member 163 is disposed so as to surround the periphery of the integral member 162. In addition, a plurality of fifth communication passages 175 are disposed in the fixed member 163 such that fuel from the high pressure chamber 169 flows into the fourth communication passage 166. In addition, the lower end portion of the fixed member 163 is attached to a stepped portion 164-*a* of the oil-tight chamber forming member 164 (having the same configuration as the fixed member shown in FIG. 15). Accordingly, the fixed member 163 fixes the oil-tight chamber forming member 164 such that the oil-tight chamber forming member 164 does not move in the axial direction. The upper end portion of the fixed member 163 is attached to a valve cylinder 174.

An oil-tight chamber 168 is formed of a space defined by the portion of the needle 17 around the lower end of the pressing portion 35, the lower end portion of the integral member 162, the oil-tight chamber forming member 164, and the nozzle body 160.

The upper end portions of the lower body 161 and the valve cylinder 174 abut the lower end portion of the valve body 170. A substantially cylindrical valve chamber 170-*b* is formed in the valve body 170. A valve spring 171 is housed in the valve chamber 170-*b*. In addition, a portion of the integral member 162 is inserted through the valve cylinder 174 and into the valve spring 171. The integral member 162 is slidably supported by the valve cylinder 174. The valve spring 171 biases the integral member 162 toward the actuator 2.

A fourth middle chamber 172, which is a flow path in which fuel flows, is disposed in the integral member 162. The lower portion of the fourth middle chamber 172 is connected to the control chamber 167. The upper portion of the integral member 162 is connected to the valve chamber 170-*b* through a fourth outer orifice 173. In other words, the integral member 162 connects the control chamber 167 with the valve chamber 170-*b* through the fourth middle chamber 172 and the fourth outer orifice 173.

The seating portion 131, having a configuration based on the example described in (4), is disposed in the valve chamber 170-*b*. The seating portion 131 is closer to the actuator 2 than the integral member 162 is to the actuator 2. Specifically, the upper end portion of the seating portion 131 abuts the drive transmission pin 5, and seats on a seat portion 170-*b* of the valve chamber 170-*b* when the actuator 2 is in a contracted state. In addition, a recessed portion, which recesses in a stepped manner toward the actuator 2, is disposed in the middle of the lower end portion of the seating portion 131. Meanwhile, a protruding portion, which protrudes toward the seating portion 131, is disposed in the middle of the upper end portion of the integral member 162.

Here, the width, in a direction orthogonal to the axial direction, of the recessed portion is formed to be wider than the width, in the same direction, of the protruding portion of the integral member 162. Accordingly, the lower end portion of the seating portion 131 and the upper end portion of the integral member 162 are fitting to each other in a convex-concave manner with a gap. Here, a height H (width in the axial direction) of the protruding portion of the integral member 162 is designed to be greater than a maximum displacement amount L of the integral member 162 caused by the actuator 2 extending. Accordingly, it is possible to reduce the possibility of the convex-concave fitting between the seating member 131 and the integral member 162 being disconnected.

The operation of the configuration shown in FIG. 33 will be explained. During a low speed valve opening control of the needle 17, the actuator 2 extends and the drive transmission pin 5 presses the seating portion 131, causing the seating portion 131 to separate from the seat portion 170-*c* of the valve chamber 170-*b*. Accordingly, the low pressure chamber 4-*b* and the valve chamber 170-*b* are connected, and the fuel in the control chamber 167 flows into the valve chamber 170-*b* through fourth middle chamber 172 and the fourth outer orifice 173. Further, the fuel in the oil-tight chamber 168 is pressurized by the integral member 162. Due to this, the needle 17 begins moving toward the actuator 2. Even if the driving of the actuator 2 is stopped, the integral member 162 is movable toward the injection hole 19. At this time, since the fuel in the high pressure chamber 169 flows through the second common orifice 121 into the control chamber 167 (the same operation as FIG. 23A), the depressurization speed of the fuel in the control chamber 167 is slowed, and the movement speed of the needle 17 toward the actuator 2 is low.

During a high speed valve opening control of the needle 17, the actuator 2 extends and the drive transmission pin 5 presses the seating portion 131, causing the seating portion 131 to separate from the seat portion 170-*c* of the valve chamber 170-*b*. Accordingly, the low pressure chamber 4-*b* and the valve chamber 170-*b* are connected, and the fuel in the control chamber 167 flows into the valve chamber 170-*b* through fourth middle chamber 172 and the fourth outer orifice 173. Meanwhile, the actuator 2 continues to extend, the oil-tight chamber 168 is pressed by the integral member 162, and the needle 17 moves toward the actuator 2. Since the needle 17 moves toward the actuator 2, the control chamber 167 is compressed.

At this time, the rate of fuel pressure increase in the control chamber 167 due to the needle 17 compressing the control chamber 167 is greater than the rate of fuel depressurization in the control chamber 167 due to the fuel in the fuel chamber 167 flowing out into the valve chamber 170-*b*. As a result, the fuel pressure in the control chamber 167 increases to exceed the fuel pressure of the high pressure chamber 169. Therefore, in addition of the fuel flowing from the control chamber 167 to the valve chamber 170-*b*, the fuel in the control chamber 167 also flows through the second common orifice 121 into the high pressure chamber 169 (the same operation as FIG. 23B). Accordingly, the depressurization speed of the fuel in the control chamber 167 increases, and thus the needle 17 moves at a high speed toward the actuator 2.

Assume, as in the above described embodiment, that the oil-tight chamber 16 is formed of a space defined by the portion of the needle 17 around the bottom end of the pressing portion 35, the lower portion of the large-diameter piston 12, and the portion of the nozzle body 15 penetrated into the lower body 10. In this case, if the needle 17 moves in a direction that causes fuel to be injected from the injection hole 19 due to the depressurization of the control chamber, the capacity of the oil-tight chamber 16 increases, and the fuel pressure in the oil-tight chamber 16 decreases.

At this time, without the configuration of the integral member 162 shown in FIG. 33, as the fuel pressure in the oil-tight chamber 16 decreases, only the large-diameter piston 12 moves in a direction the suppresses the fuel pressure in the oil-tight chamber 16 from decreasing. Accordingly, there is a concern that the control valve element 6 may stop blocking the connection between the high pressure chamber 30 and the control chamber 11. However, with a configuration that includes the integral member 162 shown in FIG. 33, as the integral member 162 moves in the axial direction the control chamber 11 also moves. Accordingly, as the integral member 162 moves, the control chamber 11 and the high pressure chamber 11 do not connect, and it is possible to suppress the fuel in the high pressure chamber 30 from leaking into the control chamber 11.

Figure 34:
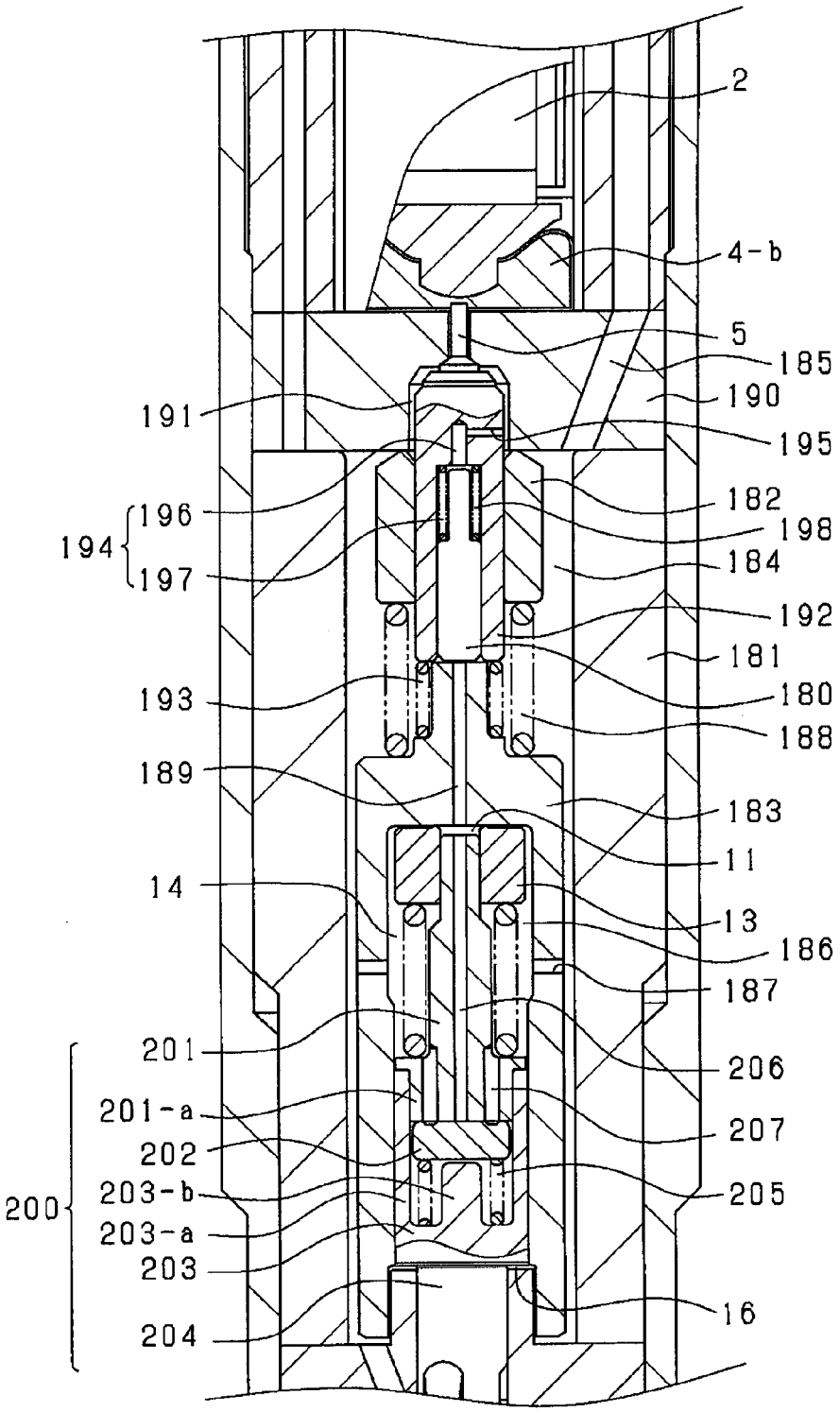
FIG. 34 is a cross sectional view of a fuel injection valve according to a modified example.

In the above described embodiment, as shown in FIG. 2, the middle chamber 23 and the outer orifice 24 are formed in the control valve element 6. The control valve element 6 is able to connect the inside of the valve cylinder 9 with the valve chamber 3-*b* through the middle chamber 23 and the outer orifice 24. However, as shown in FIG. 34, a free piston 180, which is a piston that is movable in the axial direction within a control valve element 192, may be disposed in the control valve element 192. The specific configuration of this is explained next.

A high pressure chamber 184 that houses a valve cylinder 182 and a large-diameter piston 183 is formed in a lower body 181. A second flow path 185 is connected to the high pressure chamber 184. High pressure fuel is stored in the high pressure chamber 184 through the second flow path 185.

A pressing chamber 186 is formed in the large-diameter piston 183. The pressing chamber 165 houses a portion of a needle 200. In addition, a first communication passage 187 is disposed in the large-diameter piston 183. High pressure fuel from the high pressure chamber 184 flows in through the first communication passage 187, which is connected to the pressing chamber 186.

The needle 200 includes a small-diameter piston portion 201, a joint member 201-*a*, a leak valve 202, a pressing portion 203, and a circular column portion 204. The pressing portion 203 and the circular column portion 204 are integral, while the other members are each separately provided. The nozzle spring 14 is housed in the pressing chamber 186 disposed in the large-diameter piston 183. The small-diameter piston portion 201 is inserted into the nozzle spring 14.

A recessed portion 203-*a* is formed in the middle of the upper end portion of the pressing portion 203. A protruding portion 203-*b* that protrudes toward the small-diameter piston portion 201 is formed in the middle of the recessed portion 203-*a*. The cylindrical joint member 201-*a* is fitted at the inner periphery of the upper end portion of the pressing portion 203. The leak valve 202 and a valve spring 205 are housed in the recessed portion 203-*a* of the pressing portion 203. The leak valve 202 is biased by the valve spring 205 toward the actuator 2. Accordingly, the leak valve 202 abuts the lower end portions of the small-diameter piston portion 201 and the joint member 201-*a*. In addition, a gap is formed between the leak valve 202 and the protruding portion 203-*b* of the pressing portion 203.

The lower end portion of the pressing portion 203 is coupled to the circular column portion 204.

The needle cylinder 13 is disposed at the upper end side in the pressing chamber 186. The needle cylinder 13 is formed in a substantially cylindrical shape, and is biased toward the actuator 2 by the nozzle spring 14 housed in the pressing chamber 186. In addition, the pressing portion 203 is biased toward the injection hole 19 by the nozzle spring 14 through the joint member 201-*a*.

In addition, the control chamber 11 is formed in the needle cylinder 13. The upper end portion of the small-diameter piston portion 201 is inserted into the control chamber 11. The small-diameter piston portion 201 is slidably supported by the needle cylinder 13. A first leak passage 206, in which fuel flows, is formed in the small-diameter piston portion 201 and opens at the upper and lower portions of the small-diameter piston portion 201. In addition, a second leak passage 207 is formed in the joint member 201-*a*. One end of the second leak passage 207 opens into the pressing chamber 186 closer toward the nozzle spring 14. The other end of the second leak passage 207 opens into the pressing chamber 186 closer toward the leak valve 202. The upper end portion of the leak valve 202, which is biased toward the actuator 2 by the valve spring 205, abuts the lower end portion of the small-diameter piston portion 201, thereby blocking fuel flowing from the pressing chamber 186 closer toward the leak valve 202 into the second leak passage 207.

The oil-tight chamber 16 is formed of a space defined by the portion of the needle around the lower end of the pressing portion 35, the lower portion of the large-diameter piston 12, and the portion of the nozzle body 15 that protrudes into the lower body 10.

The valve cylinder 182, which is substantially cylindrical and which is closer to the actuator 2 than the large-diameter piston 183 is to the actuator 2, is housed in the high pressure chamber 184. Further, a cylinder spring 188 is disposed between the valve cylinder 182 and the large-diameter piston 183. Due to the cylinder spring 188, the valve cylinder 182 is biased toward the actuator 2, and the large-diameter piston 183 is biased toward the injection hole 19.

The upper end portion of the lower body 181 abuts a portion of the lower end portion of the valve body 190. The lower end portion of the valve body 190 also abuts the upper end portion of the valve cylinder 182, which is biased toward the actuator 2 by the cylinder spring 188. A substantially cylindrical valve chamber 191 is formed in the valve body 190. Further, the valve body 190 includes a hole that communications between the valve chamber 191 and the inside of the valve cylinder 182. In addition, the valve body 190 includes a hole in communication with the low pressure chamber 4-*b*.

A portion of the control valve element 192 is inserted into the valve chamber 191. The control valve element 192 is slidably supported by the valve cylinder 182. The lower end portion of the control valve element 192 is exposed in the cylinder spring 188. In other words, the control valve element 192 is housed within the valve body 190, the valve cylinder 182, and the cylinder spring 188.

A protruding portion, which protrudes into the cylinder spring 188, is formed in the middle of the upper end portion of the large-diameter piston 183. The area of the upper end portion of this protruding portion is formed to be smaller than the area of the lower end portion of the control valve element 192. A valve element spring 193 is disposed in a space formed between the cylinder spring 188 and the protruding portion formed on the upper end portion of the large-diameter piston 183. Due to the valve element spring 193, the control valve element 192 is biased toward the actuator 2, and the large-diameter piston 183 is biased toward the injection hole 19.

For this reason, when the actuator 2 is in a contracted state, the large-diameter piston 183 is biased toward the injection hole 19 by the cylinder spring 188 and the valve element spring 193. Accordingly, the lower end portion of the control valve element 192 separates from the protruding portion formed in the middle of the upper end portion of the large-diameter piston 183. In addition, when the actuator 2 extends, the lower end portion of the control valve element 192 abuts with the protruding portion formed in the middle of the upper end portion of the large-diameter piston 183.

A fourth common orifice 189 is disposed in the large-diameter piston 183. The fourth common orifice 189 is able to connect the inside of the valve element spring 193 and the control chamber 11 through the protruding portion formed on the upper end portion of the large-diameter piston 183. For this reason, when the lower end portion of the control valve element 192 is separated from the protruding portion formed in the middle of the upper end portion of the large-diameter piston 183, the high pressure fuel stored in the high pressure chamber 184 is able to flow through the fourth common orifice 189 and into the control chamber 11.

Further, a fifth middle chamber 194, which is a flow path in which fuel flows, is disposed in the control valve element 192. The lower portion of the fifth middle chamber 194 opens at the lower end portion of the control valve element 192, and is in communication with the inside of the cylinder spring 188. The upper portion of the fifth middle chamber 194 is connected to the valve chamber 191 through a fifth outer orifice 195. In other words, the inside of the cylinder spring 188 and the valve chamber 191 may be connected by the control valve element 192 through the fifth middle chamber 194 and the fifth outer orifice 195.

The fifth middle chamber 194 includes a small-diameter chamber 196 and a large-diameter chamber 197.

The upper portion of the small-diameter chamber 196 is connected to the fifth outer orifice 195, while the lower portion of the small-diameter chamber 196 is connected to the large-diameter chamber 197.

The large-diameter chamber 197 is configured with a greater inner diameter than the small-diameter chamber 196. A small opening portion, which opens toward the small-diameter chamber 196, is formed at the upper portion of the large-diameter chamber 197. A large opening portion, which opens at the lower end portion of the control valve element 192, is formed at the lower portion of the large-diameter chamber 197. The free piston 180, which is movable in a direction that closes the small opening portion, is housed within the large-diameter chamber 197. The outer diameter of the upper end portion of the free piston 180 is configured to be smaller than the outer diameter of the lower end portion of the free piston 180. Here, the area of the upper end surface of the free piston 180 is configured to be sufficient to block the small opening portion formed at the upper portion of the large-diameter chamber 197. Further, the area of the lower end surface of the free piston 180 is configured to be slightly smaller than the cross sectional area of the large-diameter chamber 197.

A piston spring 198 is disposed in the upper portion of the large-diameter chamber 197, between the outer circumferential surface of the free piston 180 and the inner circumferential surface of the large-diameter chamber 197. The piston spring 198 biases the free piston 180 toward the injection hole 19, and when the actuator 2 is in a contracted state, the free piston 180 blocks a portion of the large opening portion formed at the lower portion of the large-diameter chamber 197.

When the actuator 2 is in a contracted state, a gap is formed between the lower end portion of the free piston 180 and the upper end portion of the protruding portion provided on the large-diameter piston 183. Accordingly, the high pressure chamber 184 is connected to the valve chamber 191 through the large opening portion formed in the lower portion of the large-diameter chamber 197, the fifth middle chamber 194, and the fifth outer orifice 195. Further, the high pressure chamber 184 is connected to the control chamber 11 through the fourth common orifice 189.

The drive transmission pin 5 is inserted into the hole formed in the valve body 190. A gap is formed between the drive transmission pin 5 and the hole formed in the valve body 190. The lower end portion of the drive transmission pin 5 abuts the upper end portion of the control valve element 192. The upper end portion of the drive transmission pin 5 protrudes out of the valve body 190.

The configuration of the drive transmission pin 5 on the actuator 2 side is the same as that of the above described embodiments, so explanations thereof are omitted for brevity.

Figure 35B:
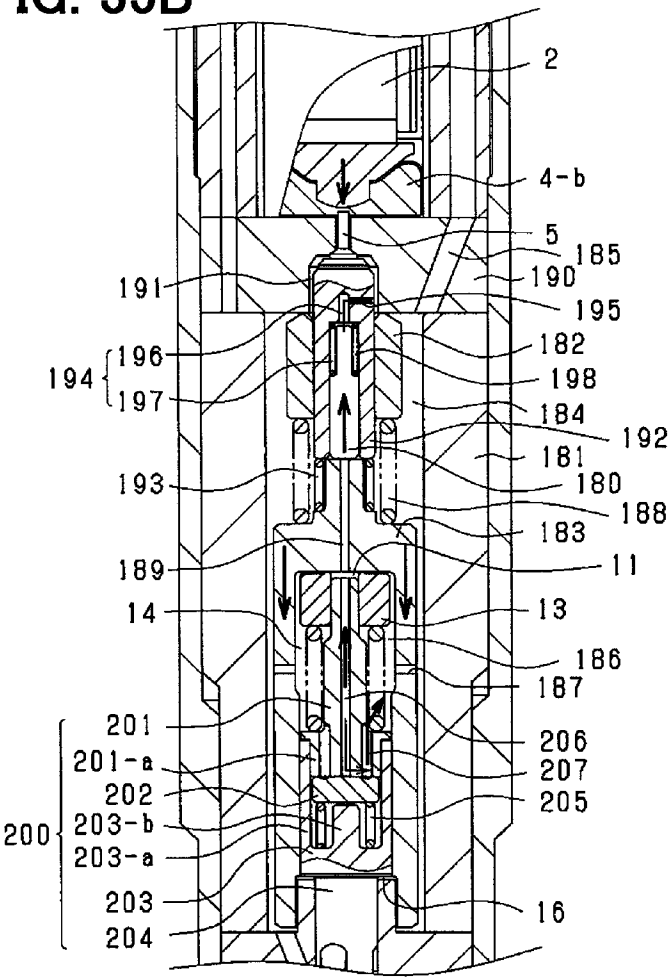
FIGS. 35A and 35B are views showing the operation of a fuel injection valve according to the modified example of FIG. 34.
Figure 35A:
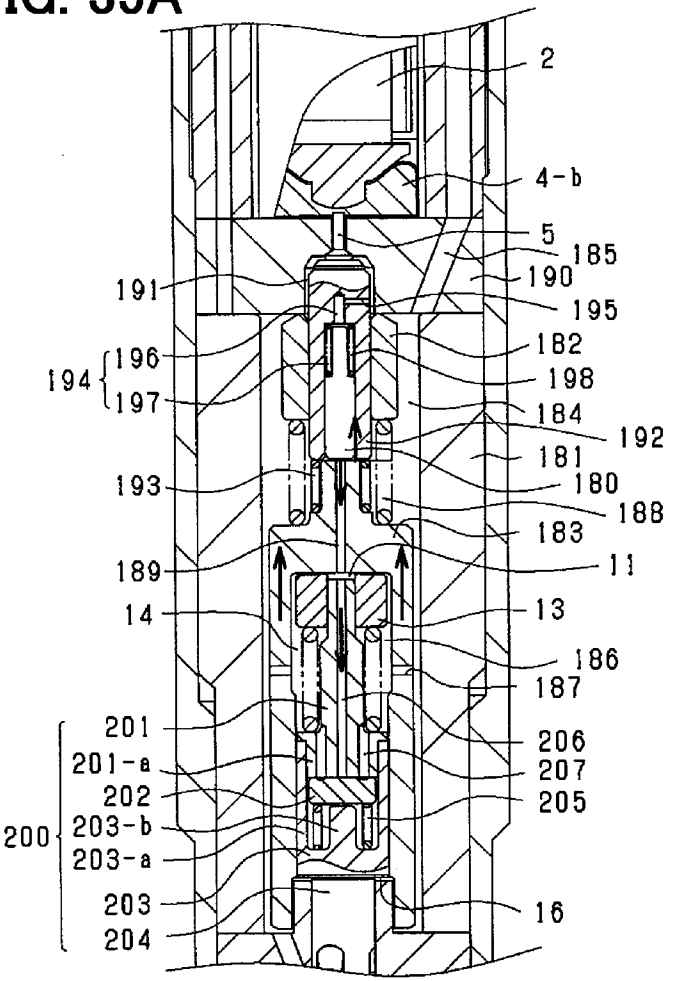

According to the above described configuration, the large-diameter chamber 197 included in the fifth middle chamber 194 houses the free piston 180, which moves in a direction that closes the small opening portion formed in the upper portion of the large-diameter chamber 197. When the actuator 2 is in a contracted state, as shown in FIG. 35A, the control valve element 192 is seated on the upper portion of the valve chamber 191, and thus the low pressure chamber 4-*b* is blocked from the valve chamber 191. During this state, the free piston 180 is biased toward the injection hole 19 by the piston spring 198, and the free piston 180 is not blocking the small opening portion formed at the upper portion of the large-diameter chamber 197. Accordingly, the fuel in the high pressure chamber 184 flows into the large-diameter chamber 197 through the large opening portion formed at the lower portion of the large-diameter chamber 197, and this fuel then flows through the small-diameter chamber 196 and the fifth outer orifice 195 into the valve chamber 191.

Meanwhile, the fuel from the high pressure chamber 184 also flows into the control chamber 11 through the fourth common orifice 189 formed in the large-diameter piston 183. For this reason, the fuel pressure in the control chamber 11 increases, and the needle 200 is pressed toward the injection hole 19. Accordingly, the oil-tight chamber 16 is pressed by the pressing portion 203 of the needle 200, thus pressing the large-diameter piston 183 toward the actuator 2. At this time, the upper end portion of the leak valve 202, which is biased toward the actuator 2 by the valve spring 205, abuts the lower end portion of the small-diameter piston portion 201. Accordingly, the fuel in the control chamber 11 does not flow out through the first leak passage 206 into the pressing chamber 186 closer toward the leak valve 202.

Here, it is supposed that the actuator 2 extends, thereby causing the lower end portion of the large-diameter chamber 197 to abut the upper end portion of the protruding portion provided on the large-diameter piston 183. In this case, as shown in FIG. 35B, the control valve element 192 connects the low pressure chamber 4-*b*, the valve chamber 191, and the control chamber 11 with each other, while blocking the high pressure chamber 184 from the control chamber 11. Accordingly, the fuel in the control valve element 192 flows out through the fifth outer orifice 195 into the low pressure chamber 4-*b*, and the fuel pressure in the control valve element 192 decreases. As this pressure decreases, the free piston 180 moves in a direction of closing the small opening portion formed at the upper portion of the large-diameter chamber 197, and during that time, the fuel pressure in the control chamber 11 decreases.

Then, once the free piston 180 blocks the small opening portion formed at the upper portion of the large-diameter chamber 197, the fuel in the control valve element 192 stops flowing out through the fifth outer orifice 195 into the low pressure chamber 4-*b*, and the fuel pressure in the control chamber 11 stops decreasing. Due to this, the fuel pressure in the control chamber 11 may be kept constant, and the movement amount of the needle in a direction that causes fuel to be injected from the injection hole 19 may be limited.

When the extension amount of the actuator 2 is large (a high speed opening of the needle 200), the large-diameter piston 183 is pressed by the control valve element 192, and the oil-tight chamber 16 is pressed by the large-diameter piston 183. For this reason, the fuel in the oil-tight chamber 16 presses the pressing portion 203, which contacts the oil-tight chamber 16, toward the actuator 2, and thus the small-diameter piston portion 201 moves toward the actuator 2. Accordingly, the control chamber 11 is compressed by the small-diameter piston portion 201, and the fuel pressure in the control chamber 11 increases. A this time, the free piston 180 is blocking the small opening portion formed at the upper portion of the large-diameter chamber 197, thus the pressure in the control chamber 11 is not released into the low pressure chamber 4-*b*. Meanwhile, since the leak valve 202 moves toward the injection hole 19, a gap is created between the lower end portion of the small-diameter piston portion 201 and the upper end portion of the leak valve 202. In other words, the control chamber 11 is connected to the pressing chamber 186 through the first leak passage 206, this gap, and the second leak passage 207. Accordingly, the fuel in the control chamber 11 may flow out through the first leak passage 206 and the second leak passage 207 into the pressing chamber 186, and thus the fuel pressure in the control chamber 11 may be quickly decreased.

The invention claimed is:

1. A fuel injection valve, comprising;

a body including a first chamber that supplies fuel at a first pressure, a second chamber that supplies fuel at a second pressure, the second pressure being lower than the first pressure, and an injection hole;

a valve chamber member including a valve chamber, the valve chamber being connectable to the first chamber and the second chamber;

a control chamber member including a control chamber, the control chamber being connectable to the first chamber;

a needle, the needle being pressed by pressure of fuel in the control chamber in a direction that causes fuel injection from the injection hole to stop;

an actuator driven to extend and contract;

a valve element that blocks the second chamber from the valve chamber and connects the first chamber, the valve chamber, and the control chamber with each other when the actuator is in a contracted state, and changes position when the actuator extends to connect the second chamber, the valve chamber, and the control chamber with each other and block the first chamber from the control chamber; and a transmission mechanism that transmits a force generated by the actuator extending, which causes the valve element to displace, to the needle as a force in a direction that causes fuel to be injected from the injection hole.

2. The fuel injection valve of claim 1, wherein a portion of the needle that receives the pressure of the fuel in the control chamber has a projection area, projected in a movement direction of the needle, that is smaller than a projection area, projected in the movement direction of the needle, of a portion of the needle exposed to the injection hole.

3. The fuel injection valve of claim 1, further comprising:

a valve biasing member that biases the valve element toward the second chamber.

4. The fuel injection valve of claim 1, wherein a common orifice is formed in a particular component of the transmission mechanism, the common orifice regulating an amount of fuel flowing into the control chamber and regulating an amount of fuel flowing out of the control chamber.

5. The fuel injection valve of claim 1, wherein an outer orifice is formed in the valve element, the outer orifice regulating an amount of the fuel flowing out from the control chamber into the valve chamber.

6. The fuel injection valve of claim 1, further comprising:

a substantially cylindrical cylinder that, together with the valve chamber member, is disposed so as to separate the valve element from the first chamber.

7. The fuel injection valve of claim 6, further comprising:

a cylinder biasing member that biases the cylinder toward the valve chamber member.

8. The fuel injection valve of claim 1, wherein the transmission mechanism includes a nozzle body that slidably supports the needle, a piston that houses a portion of the needle, the piston abutting an end surface of the needle toward the actuator when a movement amount of the needle in the direction that causes fuel to be injected from the injection hole exceeds a first predetermined amount, the first predetermined amount being set to be lower than a maximum movement amount.

9. The fuel injection valve of claim 8, further comprising:

an increase mechanism between the actuator and the valve element, the increase mechanism increasing a displacement amount by which the valve element is displaced due to the actuator extending.

10. The fuel injection valve of claim 9, wherein the increase mechanism includes a large-diameter pin connected to an end portion of the actuator toward the injection hole, a support cylinder that slidably supports a portion of the large-diameter pin, and a valve element contact pin slidably supported in the support cylinder, the valve element contact pin being moveable to press the valve element toward the injection hole, a displacement amplification chamber is formed by the support cylinder, the large-diameter pin, and the valve element contact pin, the large-diameter pin transmits a driving force from the actuator to the valve element contact pin through fuel in the displacement amplification chamber, and an area of a portion of the large-diameter pin that presses on the fuel in the displacement amplification chamber is greater than an area in which the fuel in the displacement amplification chamber presses on the valve element contact pin.

11. A controller that controls the fuel injection valve of claim 8, wherein upon the movement amount of the needle in the direction that causes fuel to be injected from the injection hole exceeding the first predetermined amount, the controller controls the piston to regulate the movement amount of the needle due to the actuator being driven to extend and contract.

12. The controller of claim 11, wherein the controller regulates the movement amount of the needle based on the fuel pressure in the control chamber during a first stage injection and a last stage injection of a multi-stage injection, the multi-stage injection being performed as a plurality of fuel injections during one combustion cycle of an internal combustion engine, and the controller controls the piston, which is maintained in a state of abutting the end surface of the needle toward the actuator, to regulate the movement amount of the needle due to the actuator being driven to extend and contract during all injections of the multi-stage injection other than the first injection and the last injection.

13. The fuel injection valve of claim 1, wherein the transmission mechanism includes a nozzle body that slidably supports the needle, and a piston that, together with the needle and the nozzle body, forms an oil-tight chamber, wherein the piston transmits a driving force of the actuator through fuel in the oil-tight chamber to the needle.

14. The fuel injection valve of claim 13, wherein an area of a portion of the piston that presses on the fuel in the oil-tight chamber is greater than an area of a portion of the needle pressed against by the fuel in the oil-tight chamber in the direction that causes fuel injection from the injection hole to stop.

15. The fuel injection valve of claim 1, wherein the transmission mechanism includes a nozzle body that slidably supports the needle, a piston that houses a portion of the needle, and a second cylinder housed in the piston so as to surround the needle, the second cylinder, together with the needle and the nozzle body, forming an oil-tight chamber, wherein the second cylinder includes a second cylinder end portion toward the actuator, a first gap exists between the second cylinder end portion and a surface of the piston that faces the second cylinder end portion, the piston transmits a driving force of the actuator through fuel in the oil-tight chamber to the second cylinder and the needle when the first gap exists, and the piston and the second cylinder transmit the driving force of the actuator through fuel in the oil-tight chamber to the needle when the first gap is closed.

16. The fuel injection valve of claim 15, wherein a quotient obtained by dividing i) an area of a portion of the piston that presses on the fuel in the oil-tight chamber by ii) a total area of portions of the needle and the second cylinder pressed on by the fuel in the oil-tight chamber is greater than a quotient obtained by dividing i) a total area of the portions of the piston and the second cylinder that press on the fuel in the oil-tight chamber by ii) an area of the portion of the needle pressed on by the fuel in the oil-tight chamber toward the actuator.

17. The fuel injection valve of claim 1, wherein the transmission mechanism includes a nozzle body that slidably supports the needle, a third cylinder supported by the nozzle body, and a piston that, together with the third cylinder and the nozzle body, forms an oil-tight chamber, wherein the piston transmits a driving force of the actuator through fuel in the oil-tight chamber to the third cylinder, and the third cylinder abuts the needle to transmit the transmitted driving force to the needle as a force in the direction that causes fuel to be injected from the injection hole.

18. The fuel injection valve of claim 1, further comprising:

a piston biasing member, wherein the valve element includes a second chamber connection member that blocks the second chamber from the valve chamber and connects the first chamber with the valve chamber when the actuator is in the contracted state, and changes position when the actuator extends to connect the second chamber with the valve chamber, and a first chamber connection member that separates from the second chamber connection member when the actuator is in the contracted state to connect the first chamber with the control chamber, and abuts the second chamber connection member when the actuator extends to connect the valve chamber with the control chamber and to block the first chamber from the control chamber, the transmission mechanism includes a nozzle body that slidably supports the needle, and a piston that, together with the needle and the nozzle body, forms an oil-tight chamber, the piston transmits a driving force of the actuator through the first chamber connection member and the second chamber connection member, the piston is biased by the piston biasing member toward the actuator to abut the first chamber connection member, the control chamber member includes a control chamber member end portion toward the actuator, and a second gap exists between the control chamber member end portion and a surface of the piston that faces the control chamber member end portion when the piston is abutting the first chamber connection member.

19. The fuel injection valve of claim 18, wherein a width of the second gap between the piston and the control chamber member is greater than a value calculated by dividing i) a maximum movement amount of the needle in the direction that causes fuel to be injected from the injection hole by ii) a quotient obtained by dividing an area of a portion of the piston pressing on fuel in the oil-tight chamber by an area of a portion of the needle pressed on by the fuel in the oil-tight chamber in the direction that causes fuel to be injected from the injection hole.

20. The fuel injection valve of claim 1, wherein an end surface of the control chamber member toward the actuator is exposed in the control chamber.

21. The fuel injection valve of claim 20, wherein a second outer orifice connected to the first chamber is provided, the second outer orifice being connected to the control chamber during an abutting state and being blocked from the control chamber when the abutting state is canceled, the abutting state exists when the end surface of the control chamber member toward the actuator abuts an opposing surface of the control chamber, the abutting state being canceled when the control chamber member moves toward the injection hole, and the second outer orifice is the only path through which fuel in the control chamber flows out into the first chamber when the abutting state is canceled.

22. The fuel injection valve of claim 1, wherein a second common orifice in communication with the first chamber is connected to the control chamber.

23. The fuel injection valve of claim 1, wherein the valve element includes a sliding portion that connects the first chamber, the valve chamber, and the control chamber with each other when the actuator is in the contracted state, and changes position when the actuator extends to block the first chamber from the control chamber and to connect the control chamber to the valve chamber, and a seating portion that is movable in an axial direction while abutting an end surface of the sliding portion toward the actuator, the seating portion blocking the second chamber from the valve chamber when the actuator is in the contracted state, and changing position when the actuator extends to connect the second chamber with the valve chamber.

24. The fuel injection valve of claim 23, wherein an outer orifice is formed in the sliding portion, the outer orifice regulating an amount of the fuel flowing out from the control chamber into the valve chamber.

25. The fuel injection valve of claim 23, wherein the transmission mechanism includes a nozzle body that slidably supports the needle, and a piston that, together with the needle and the nozzle body, forms an oil-tight chamber, and the piston, the control chamber member, and the sliding portion are integrally provided.

26. The fuel injection valve of claim 23, wherein a surface of the seating portion that contacts the valve chamber when the actuator is in the contracted state is formed as a spherical surface.

27. The fuel injection valve of claim 23, wherein the sliding portion and the seating portion include complimentary protruding and recessed portions that fit with each other in a convex-concave manner such that surfaces of the sliding portion and the seating portion are in contact with each other with a gap.

28. The fuel injection valve of claim 27, wherein a height of the protruding portion of the complimentary protruding and recessed portions is greater than a maximum movement amount of the sliding portion.

29. The fuel injection valve of claim 1, wherein an outer orifice is formed in the valve element to regulate an amount of the fuel flowing out from the control chamber into the valve chamber, and a second piston is housed in the valve element, the second piston being movable in a direction to prevent fuel from flowing through the outer orifice into the second chamber.

30. The fuel injection valve of claim 1, wherein the actuator is formed of piezo elements.

31. A controller that controls the fuel injection valve of claim 1, wherein the controller includes a first charge control mode and a second charge control mode which differ in charge energy timing, the charge energy timing being defined as when reaching a required amount of charge energy from a start of charging the actuator until the needle causes fuel to be injected from the injection hole, during the first charge control mode, the charge energy timing is set to be later than a depressurization completion timing, the depressurization completion timing being when the control chamber is depressurized to a predetermined pressure required for the needle to cause fuel to be injected from the injection hole, and during the second charge control mode, the charge energy timing is set to be earlier than a depressurization completion timing.

32. The controller of claim 31, wherein the first charge control mode is configured to have a greater final charge energy ultimately charged to the actuator as compared to the second charge mode.

33. The control of claim 31, wherein the first charge control mode is configured to have an earlier connection operation energy timing as compared to the second charge control mode, the connection operation energy timing being when reaching a connection operation energy required for the valve element to block the control chamber from the first chamber and to connect the valve chamber with the second chamber.

* * * * *